US008864195B2

(12) United States Patent
Sullivan

(10) Patent No.: US 8,864,195 B2
(45) Date of Patent: Oct. 21, 2014

(54) ADJUSTABLE SLIDING DOOR, WINDOW, OR PANEL LOCK

(75) Inventor: Thomas D. Sullivan, Hamilton, NJ (US)

(73) Assignee: Accession, Inc., Hamilton, NJ (US)

( * ) Notice: Subject to any disclaimer, the term of this patent is extended or adjusted under 35 U.S.C. 154(b) by 237 days.

(21) Appl. No.: 13/328,426

(22) Filed: Dec. 16, 2011

(65) Prior Publication Data

US 2012/0169074 A1 Jul. 5, 2012

Related U.S. Application Data

(60) Provisional application No. 61/460,246, filed on Dec. 29, 2010.

(51) Int. Cl.

| | |
|---|---|
| ***E05C 17/54*** | (2006.01) |
| ***E05C 17/60*** | (2006.01) |
| ***E05B 65/08*** | (2006.01) |
| *E05C 21/02* | (2006.01) |
| *E05C 17/04* | (2006.01) |
| *E05C 19/18* | (2006.01) |

(52) U.S. Cl.

CPC ..... *E05C 17/60* (2013.01); *E05B 65/0888* (2013.01); *Y10S 292/46* (2013.01); *Y10S 292/53* (2013.01); *Y10S 292/54* (2013.01); *Y10S 292/60* (2013.01)

USPC ..... 292/343; 292/259 R; 292/262; 292/288; 292/289; 292/DIG. 46; 292/DIG. 53; 292/DIG. 54; 292/DIG. 60

(58) Field of Classification Search

CPC ..... E05C 19/003; E05C 17/54; E05C 17/30

USPC ..... 292/259 R, DIG. 60, DIG. 46, DIG. 53, 292/343, 342, 1, 262, 263, 265–270, 288, 292/289, DIG. 15, DIG. 54

See application file for complete search history.

(56) References Cited

U.S. PATENT DOCUMENTS

| | | | | | |
|---|---|---|---|---|---|
| 2,594,605 | A | * | 4/1952 | Zoppelt | 211/123 |
| 3,698,754 | A | * | 10/1972 | Means | 292/262 |
| 3,797,005 | A | * | 3/1974 | Schwarz | 340/542 |
| 4,295,676 | A | * | 10/1981 | Smith | 292/262 |
| 4,461,502 | A | * | 7/1984 | Burgess | 292/262 |
| 4,495,486 | A | | 1/1985 | White | |
| 4,553,134 | A | | 11/1985 | Holt | |
| 4,570,985 | A | * | 2/1986 | Waldo et al. | 292/262 |
| 4,598,572 | A | * | 7/1986 | Mondello et al. | 29/243.522 |
| 4,639,023 | A | * | 1/1987 | Boisvert | 292/262 |

(Continued)

*Primary Examiner* — Kristina Fulton
*Assistant Examiner* — Faria Ahmad
(74) *Attorney, Agent, or Firm* — Watov & Kipnes, P.C.; Kenneth Watov

(57) ABSTRACT

An adjustable lock for a sliding member such as a sliding door, sliding panel, or sliding window is provided by a tubular mechanism adapted to be placed into a position wedging the tubular mechanism between the frame and the sliding member, with the tubular mechanism including an inner tubular member selectively threadably extendable from within an outer tubular member attached to the frame to a locked position locking the outer and inner tubular members together, with a free end of the inner tubular member is proximate an edge portion of the associated sliding member, whereby the locked together outer and inner tubes are rotatable in one direction for extending and forcing a free end of the inner tubular member into intimate contact with the edge portion of the sliding member, thereby wedging the sliding member into a locked position preventing movement thereof.

19 Claims, 30 Drawing Sheets

(56) References Cited

U.S. PATENT DOCUMENTS

| | | | | | |
|---|---|---|---|---|---|
| 4,792,168 | A * | 12/1988 | Kardosh | 292/288 |
| 4,837,557 | A | 6/1989 | Striebel | |
| 4,895,471 | A * | 1/1990 | Geltz et al. | 403/104 |
| 4,896,139 | A | 1/1990 | Eldridge | |
| 4,979,769 | A * | 12/1990 | Salyer | 292/338 |
| 5,303,832 | A * | 4/1994 | Tu | 211/105.4 |
| 5,509,235 | A * | 4/1996 | Chander | 49/383 |
| 6,388,572 | B1 | 5/2002 | Salter | |
| 6,943,686 | B2 | 9/2005 | Allen | |
| 7,207,141 | B2 | 4/2007 | Sullivan | |
| 7,314,240 | B1 * | 1/2008 | McPherson | 292/259 R |
| 7,628,430 | B2 * | 12/2009 | Whitaker | 292/259 R |
| 2007/0284324 | A1 * | 12/2007 | Goldstein | 211/105.3 |
| 2008/0018118 | A1 * | 1/2008 | Schultz | 292/259 R |
| 2008/0277922 | A1 * | 11/2008 | Ghidini | 285/34 |
| 2009/0267356 | A1 * | 10/2009 | VanHellemont | 292/96 |

* cited by examiner

ADJUSTABLE SLIDING DOOR, WINDOW, OR PANEL LOCK

RELATED PATENT AND APPLICATION

The present invention is related to U.S. Pat. No. 7,207,141, entitled "Sliding Door Insert for Portable Pet Portal," issued on Apr. 24, 2007, and to Provisional Application No. 61/460,246 filed on Dec. 29, 2010. Also, this Application takes priority from the Provisional Application No. 61/460,246 that has the same title herewith. The teachings of the related patent and application are incorporated by reference herein to the extent that they do not conflict herewith.

FIELD OF THE INVENTION

The present invention relates generally to sliding windows and sliding glass patio doors, and more particularly to locks for such windows and doors.

BACKGROUND OF THE INVENTION

Pet access doors provide an opening, usually equipped with a swinging flap, through which pets can leave or enter a home or other building. In order to allow a means of passage for a pet through a sliding glass patio door, the movable patio door must be left ajar by sliding the movable door away from the patio door frame. The majority of pet access doors manufactured for sliding glass patio doors consist of a rectangular panel designed to fill the opening created when the sliding glass patio door is ajar. Generally sliding glass patio door pet access doors are constructed of a glass panel in the upper portion and a swinging flap pet portal in the lowermost portion encased in an aluminum frame. The pet door panel is installed in the opening in the patio door created when the movable patio door is left ajar. After installation, the movable patio door is closed by sliding it against the pet door panel to prevent air and insect infiltration into the interior space of the building. When configured in this manner the movable door of the sliding glass patio door no longer engages the catch mechanism in the normally adjacent patio door frame as the pet door panel when installed prevents engagement. Most pet door panels manufactured for sliding glass patio doors are supplied with a locking mechanism to prevent the movable patio door from being opened unintentionally as by a child or intruder. All locks supplied with pet door panels for sliding glass patio doors require drilling into the patio door and/or tools to complete the installation, if a patio door lock is supplied at all. Some patio door pet door panel suppliers simply advise the consumer to cut a length of material like a wooden dowel to fit between the patio door frame opposing the trailing edge of the movable patio door and the trailing edge of the movable patio door. The dowel is then dropped into the lower channel of the patio door between the opposing patio door frame and the trailing edge of the movable patio door to prevent the patio door from being opened unintentionally. These types of patio door locks are inconvenient to either install or use and in some cases may void the patio door manufacturer's warrantee. Most of the locks or when necessary cut dowels are not adjustable, therefore, the movable sliding patio door cannot be sealed against the pet door panel with too much pressure since it will be too difficult for the lock or dowel to be removed to open the movable sliding patio door. Similar locking problems relate to sliding glass windows.

The purpose of the present invention is to provide a portable adjustable sliding window and/or door lock that requires no drilling or tools and is easy to install and use for sliding glass patio doors configured for use with pet door panels. Also, the adjustability of the patio door lock permits use with any patio pet door panel currently on the market while providing superior sealing capability.

SUMMARY OF THE INVENTION

The present invention provides an improved door lock for use on sliding glass patio doors with a pet door panel installed. While the primary purpose of the present invention is for use with pet door panels for sliding glass patio doors, it can also be used to secure other types of vertical or horizontal sliding doors, panels, or windows, for example. In one embodiment of the invention, a unique threaded telescoping design permits a wide range of retraction and extension that will accommodate a variety of widths of sliding glass patio doors, pet door panels, and sliding glass windows. In another embodiment, a threaded fine adjustment feature of the present invention permits pressure to be applied to the movable patio door and pet door panel insert to help ensure a weather tight fit of the pet door panel in the sliding glass patio door simply by rotating in one direction the body of the present inventive door lock. Rotating the body in the opposite direction relieves the pressure against the patio door and permits the present invention to be placed in a resting unlocked position so that the movable sliding patio door can be opened for passage by a person or for removal or installation of a pet door panel, for example. Similar operation of the present door lock is provided for use with sliding windows.

BRIEF DESCRIPTION OF THE DRAWINGS

Various embodiments of the present invention are described in detail below with reference to the drawings, in which like items are identified by the same reference designation, wherein.

DETAILED. DESCRIPTION OF THE INVENTION

Figure 1:
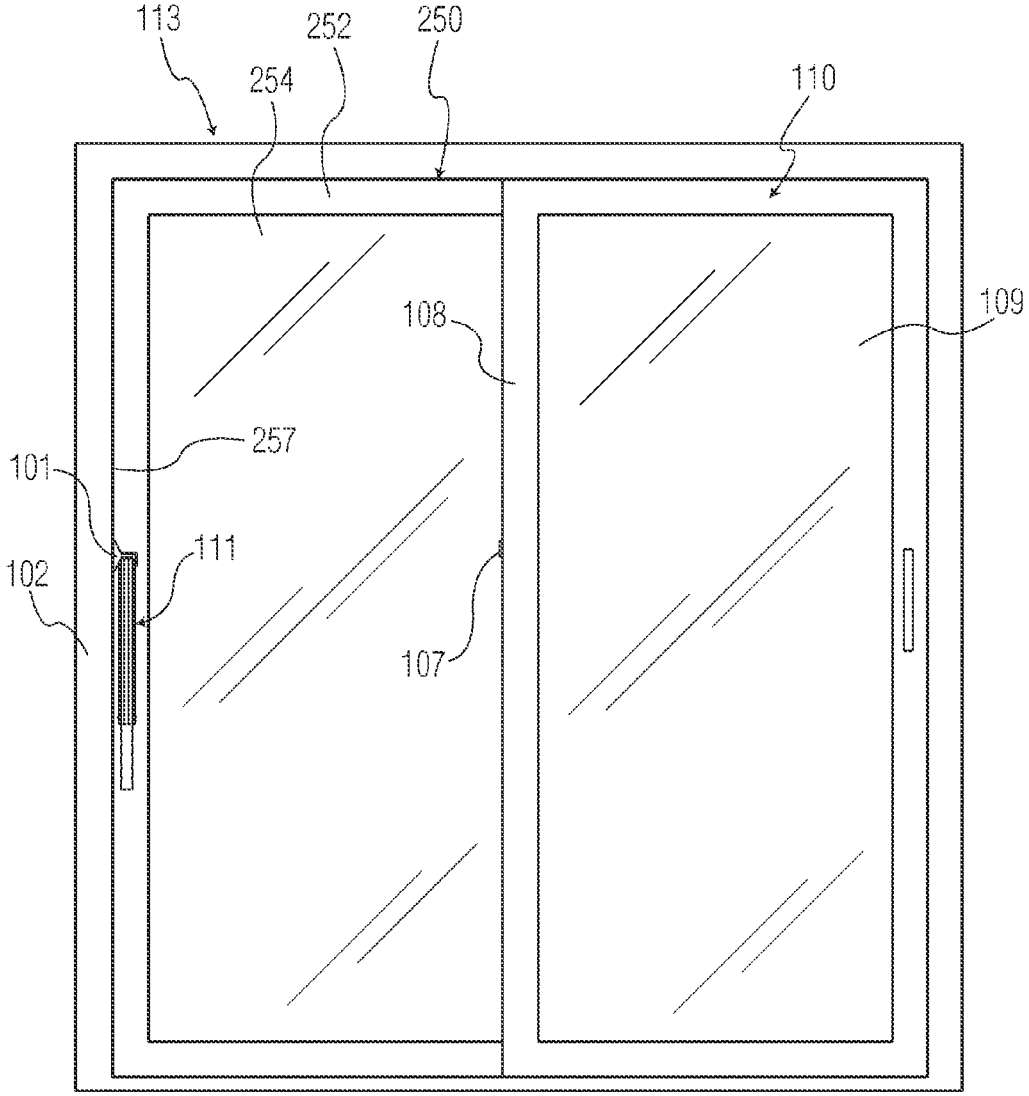
FIG. 1 is an interior elevational view of a sliding glass patio door with the adjustable patio door lock installed in the resting unlocked position, for one embodiment of the present invention.

The present inventive adjustable sliding door lock 111 and mounting bracket 101 are shown in FIG. 1 at rest in an unlocked position on a patio door frame 102 of patio door 113 in a closed position. The patio door 113 includes a stationary door portion 250 with frame 252 and glass 254. Patio door 113 also includes a movable door 110 with frame 108 and glass portion 109. Although the present invention is described in association with a sliding glass patio door, the invention is not meant to be so limited, in that it can also be used for providing a lock for sliding windows, sliding panel closures, and so forth. Note that the mounting bracket 101 is secured to a channel portion 257 of patio door frame 102.

Figure 2:
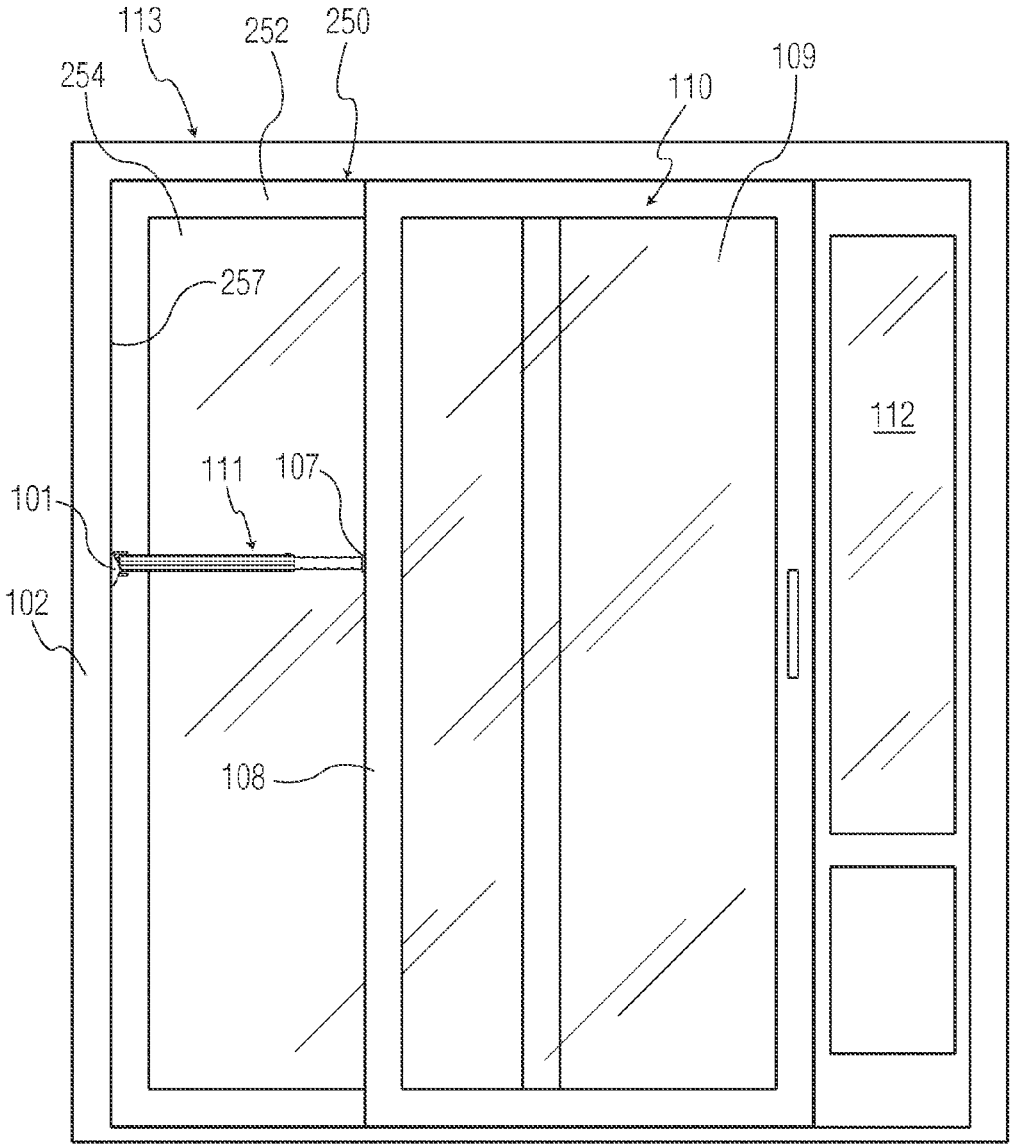
FIG. 2 is an interior elevational view of a sliding glass patio door with a pet door access panel installed and the adjustable patio door lock in the locked position, for another embodiment of the invention.

The adjustable door lock 111 and mounting bracket 101 are shown in FIG. 2 in the locked position wedged between patio door frame 102 and a retaining cup 107 attached to stile 108 of movable sliding patio door 110 of sliding glass patio door 113 with a pet door panel 112 installed. It should be noted that adjustable sliding door lock 111 may be utilized without mounting bracket 101 and without retaining cup 107. While FIG. 2 shows adjustable sliding door lock 111 used to lock sliding glass patio door 113 with pet door panel 112 installed, it should be noted that in another embodiment of the invention adjustable sliding door lock 111 may be used to secure the movable sliding patio door 110 of sliding glass patio door 113 in a closed position without pet door panel 112 installed, or it can be used to secure other types of sliding doors or windows.

Figures 3, 4, 5, 6:
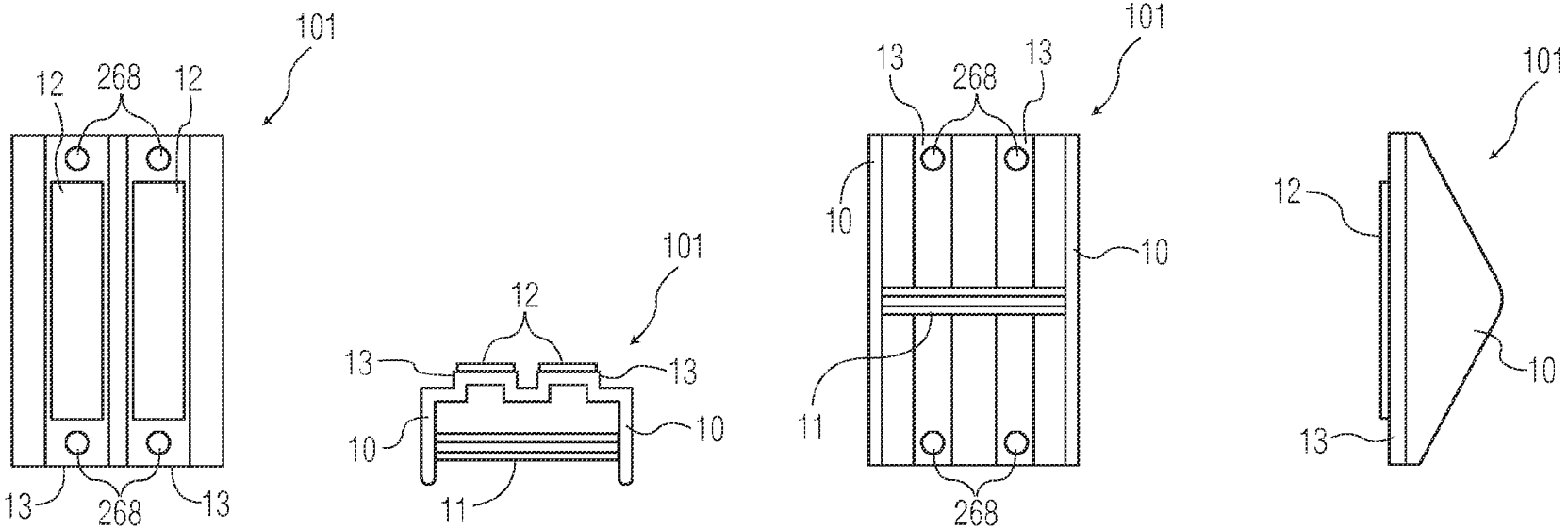
FIGS. 3 through 6 show a back elevational, top plan (the bottom plan view is identical), front elevational and right-side elevational (the left-side elevational being a mirror image thereof) views, respectively, for a mounting bracket for an embodiment of the invention.

An Adjustable sliding door lock mounting bracket 101 is shown in FIGS. 3 through 6 depicting back, top plan (bottom plan being identical), front and right side (left side being identical) views, respectively. A mounting hinge bar 11 of mounting bracket 101 is supported on two sides by side walls 10 as shown in FIGS. 4 and 5. Adhesive strips or adhesive backed hook and loop strips 12 located on mounting pads 13, or screws (not shown) through holes 268, are used to attach the mounting bracket 101 to the patio door frame 102 of sliding glass patio door 113 as shown in FIGS. 1 and 2, and further illustrated in FIGS. 7 through 11. Alternatively mounting bracket 101 can be attached to movable patio door 110 (not shown) and retaining cup 107 can be attached to patio door frame 102 (not shown) of sliding glass patio door frame 113.

Figure 7:
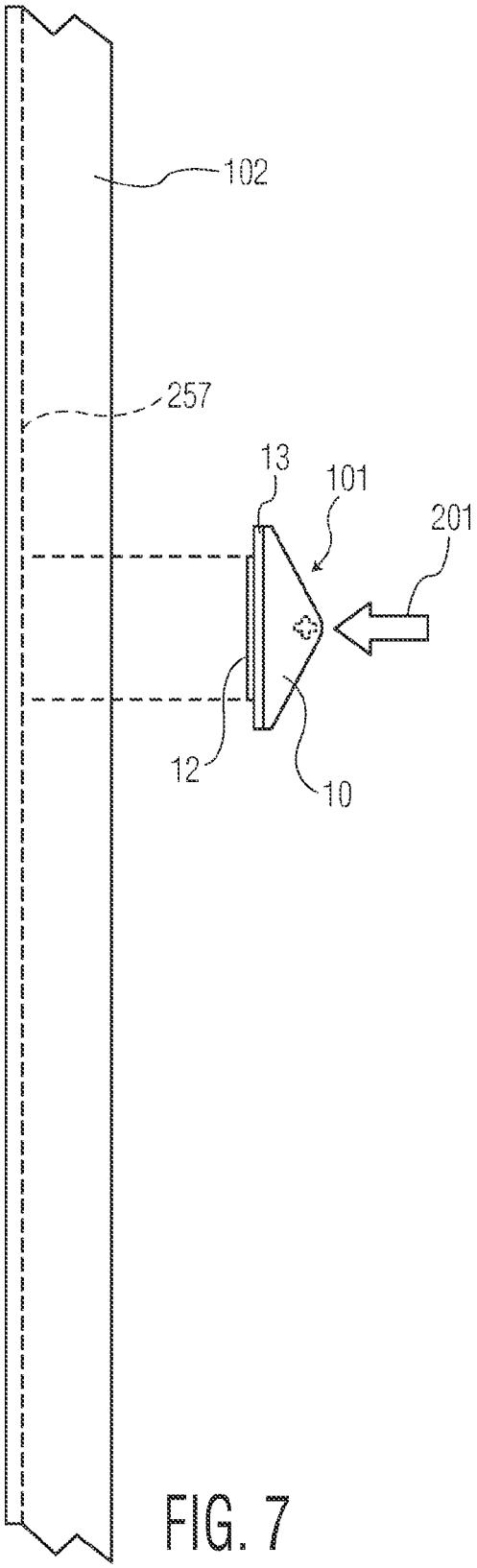
FIGS. 7 through 9 show an installation sequence of the mounting bracket in a right side partial view of a patio door frame channel, for an embodiment of the invention.
Figure 8:
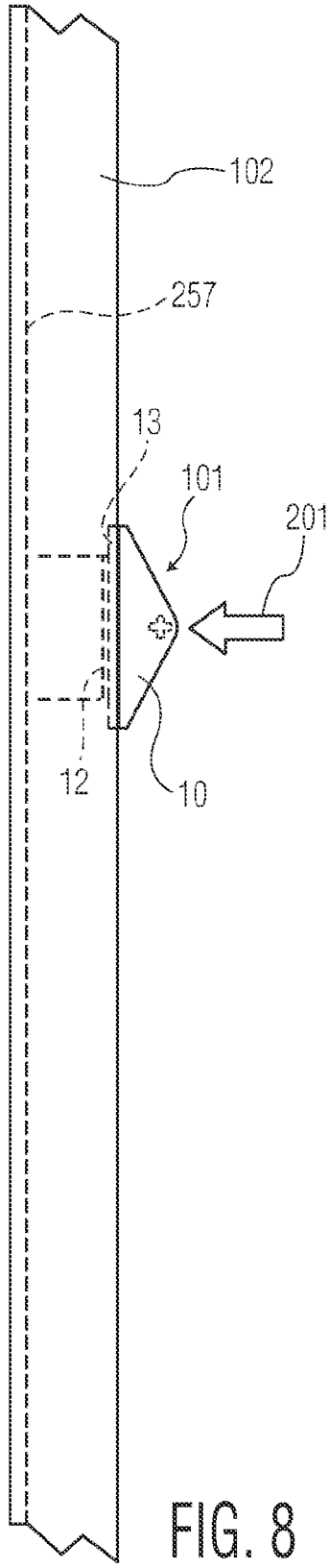
Figure 9:
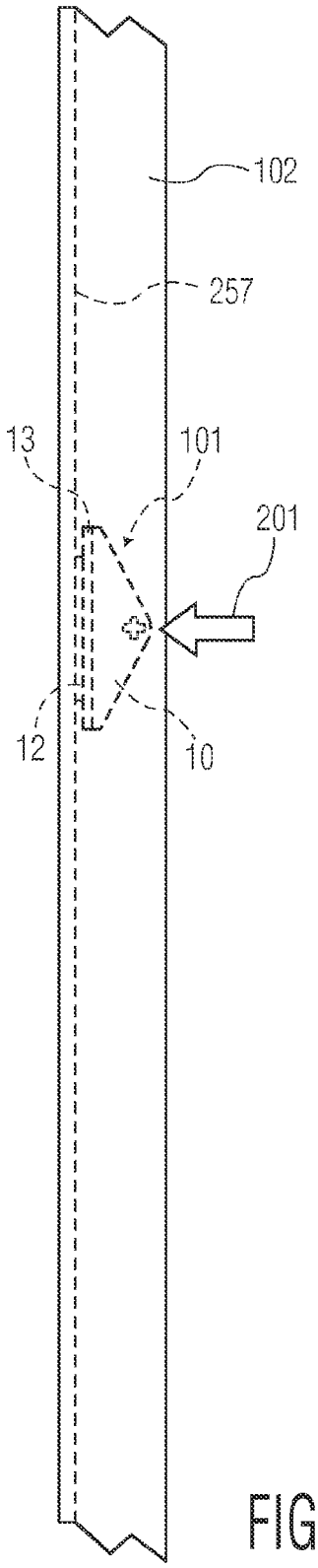
Figure 10:
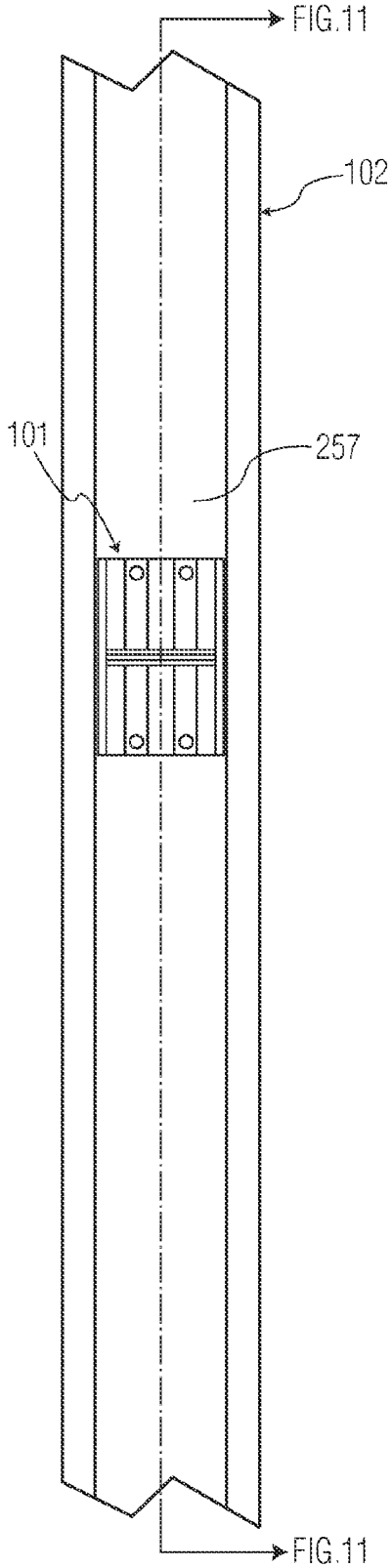
FIG. 10 is a partial front elevational view of the mounting bracket and patio door frame channel.
Figure 11:
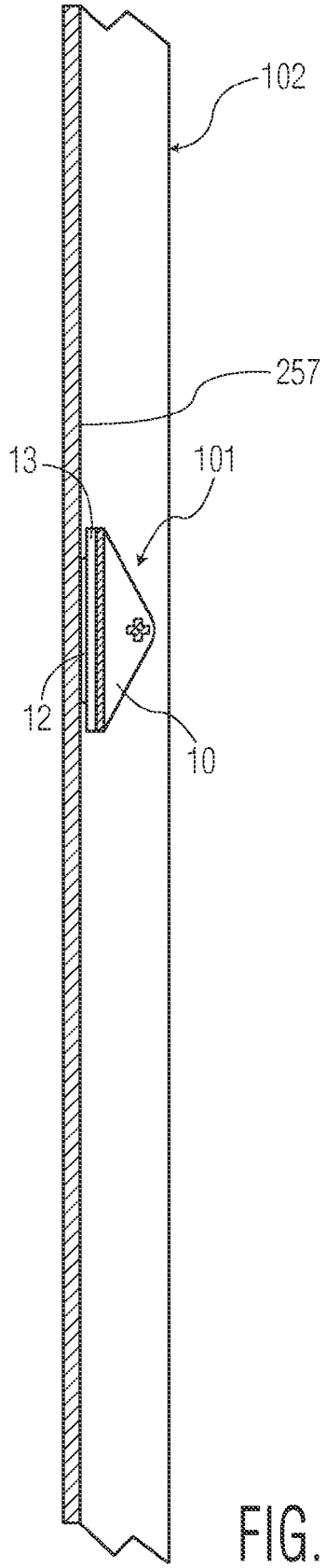
FIG. 11 is a partial cross sectional view at taken along 11-11 of FIG. 10 of the mounting bracket in the patio door frame channel.
Figure 15:
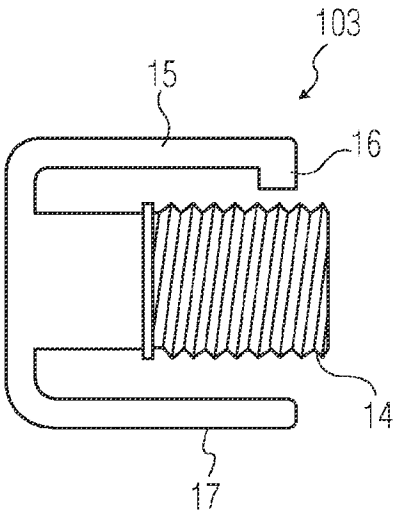
FIGS. 12, 13, 14 and 15 are an elevational back view, a top plan view (bottom plan being identical), front elevational view, and left side elevational view (right side elevational view being a mirror image), respectively, of a threaded fine adjustment mounting component, for an embodiment of the invention.
Figure 14:
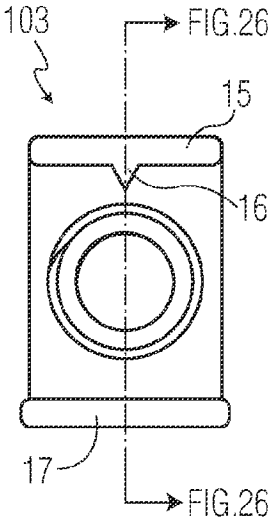
Figure 13:
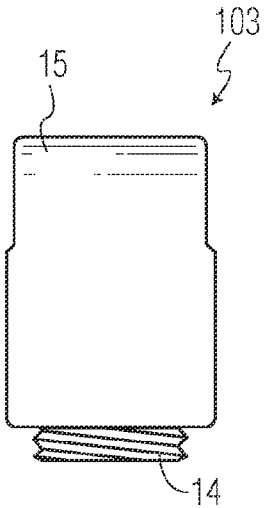
Figure 12:
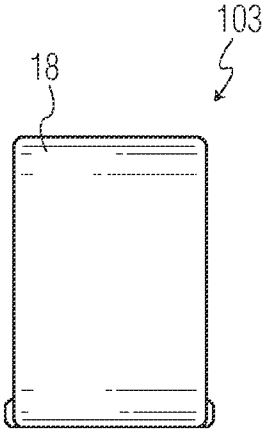

FIGS. 7 through 9 illustrate assembly of mounting bracket 101 to patio door frame 102. The directional arrow 201 shows how the mounting bracket 101 with adhesive strips 12 and associated mounting pads 13 are situated in or on patio door frame 102. FIG. 10 is a partial front elevational view showing mounting bracket 101 as installed on or in the patio door frame 102 channel 257. FIG. 11 shows the mounting bracket 101 installed in the channel 257 of patio door frame 102.

Figure 16:
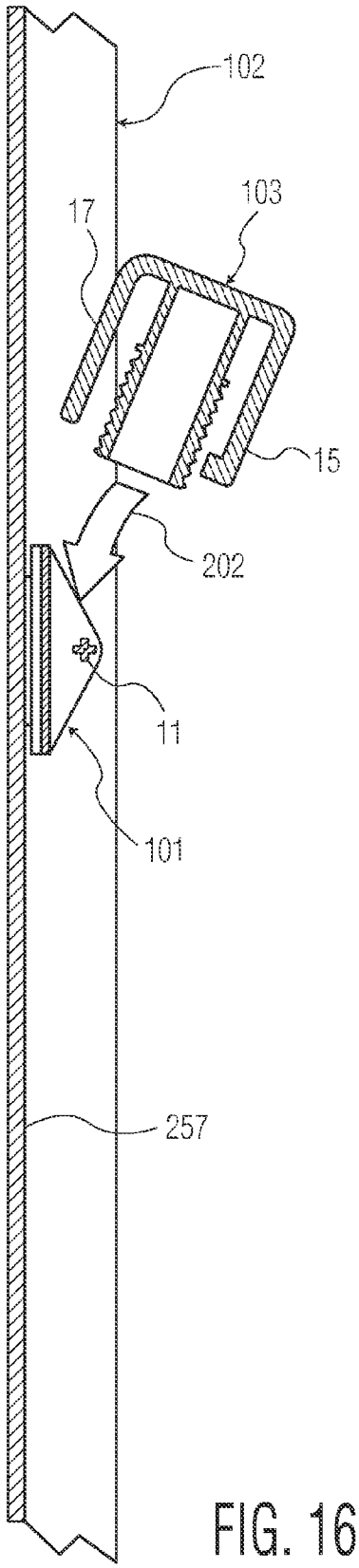
FIGS. 16 through 18 show a cross sectional installation sequence of the mounting component of the patio door lock of FIGS. 12-15, onto the mounting bracket of FIGS. 3-6 in the patio door frame channel.
Figure 17:
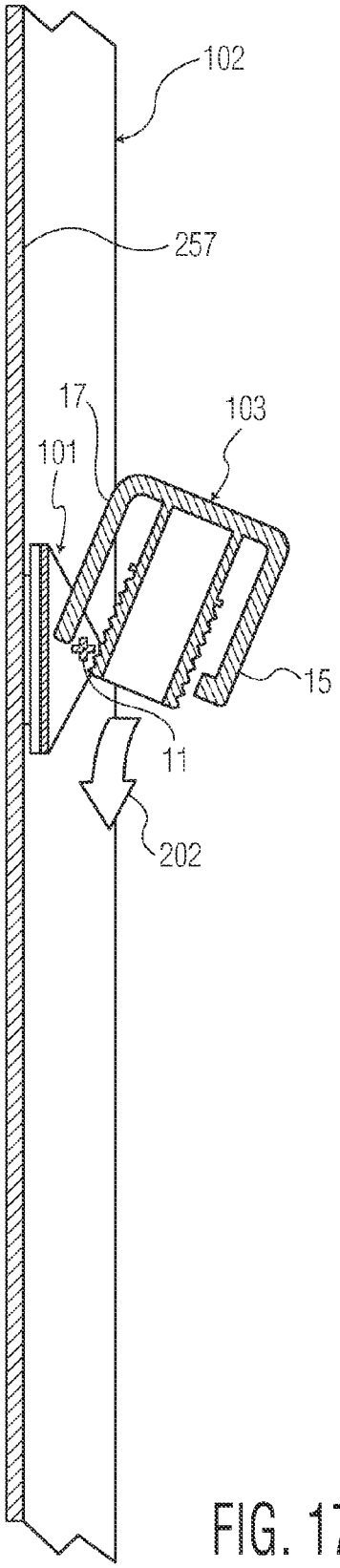
Figure 18:
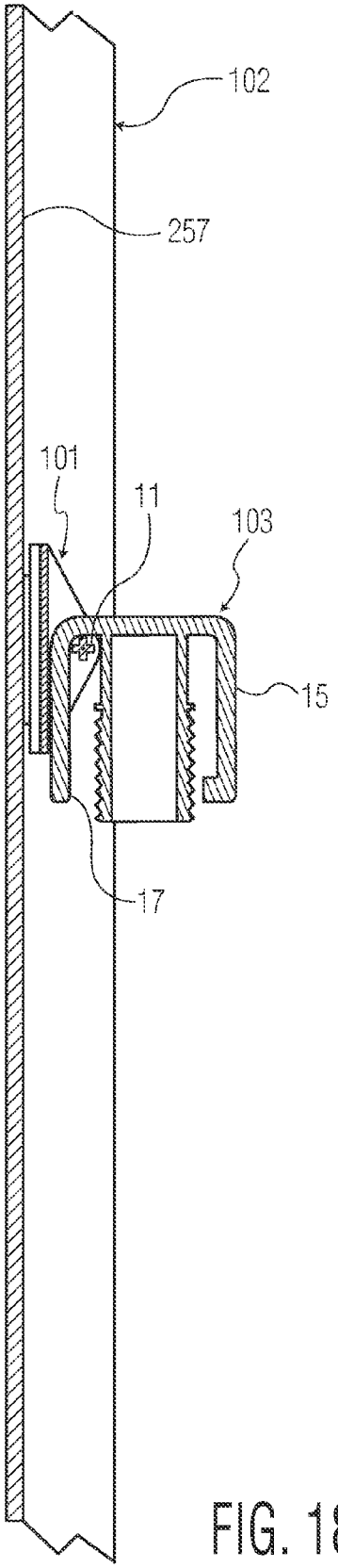

A threaded fine adjustment mounting component 103 shown in FIGS. 12 through 15 in interior back, top plan (bottom plan being identical) front and left side (right side being a mirror image) views, respectively, show a threaded fine adjustment feature or stud 14 used in combination with an outer fine adjustment tube or barrel 104 (see FIGS. 22 through 25) to achieve finite adjustment of adjustable sliding door lock 111. Drag arm 15 of the threaded fine adjustment mounting component 103 is designed to support drag tab 16 that is suspended over and engages a serrated portion 20 of outer fine adjustment barrel 104 (see FIGS. 22 through 25). Mounting arm 17 of mounting bracket 103 slides over hinge bar 11 of mounting bracket 101. Drag arm 15 is elastic or flexible and has memory for its rest position FIGS. 16 through 18 are cross sectional views of patio door frame 102, mounting bracket 101, and threaded fine adjustment mounting component 103, showing the process of inserting mounting arm 17 of mounting threaded fine adjustment mounting component 103 onto hinge bar 11 of mounting bracket 101.

Figure 19:
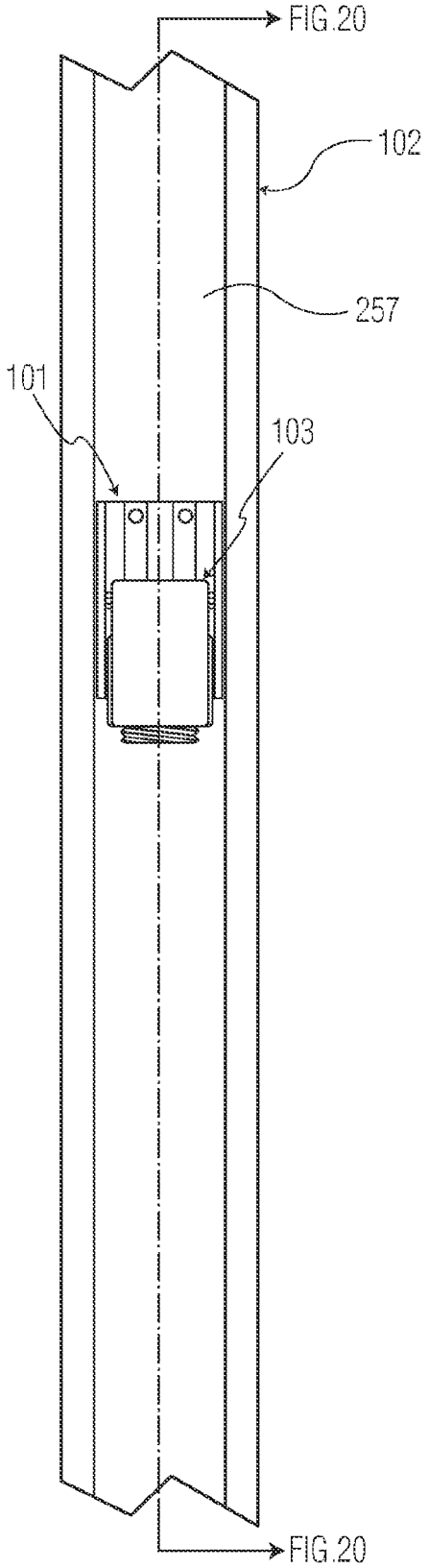
FIG. 19 is a partial front view of the patio door frame channel with the mounting component installed on the mounting bracket.

FIG. 19 shows a partial front elevational view of threaded fine adjustment mounting component 103 inserted into mounting bracket 101 in patio door frame 102.

Figure 20:
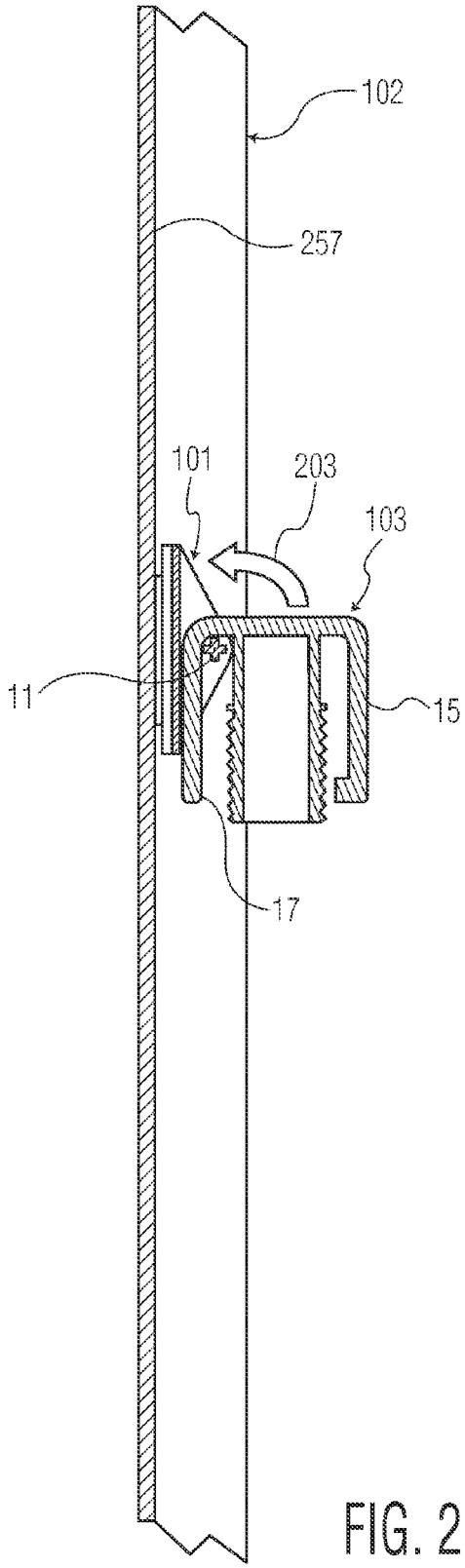
FIG. 20 is a partial cross sectional view taken along 20-20 of FIG. 19 of the mounting component installed on the mounting bracket in the patio door frame channel.
Figure 21:
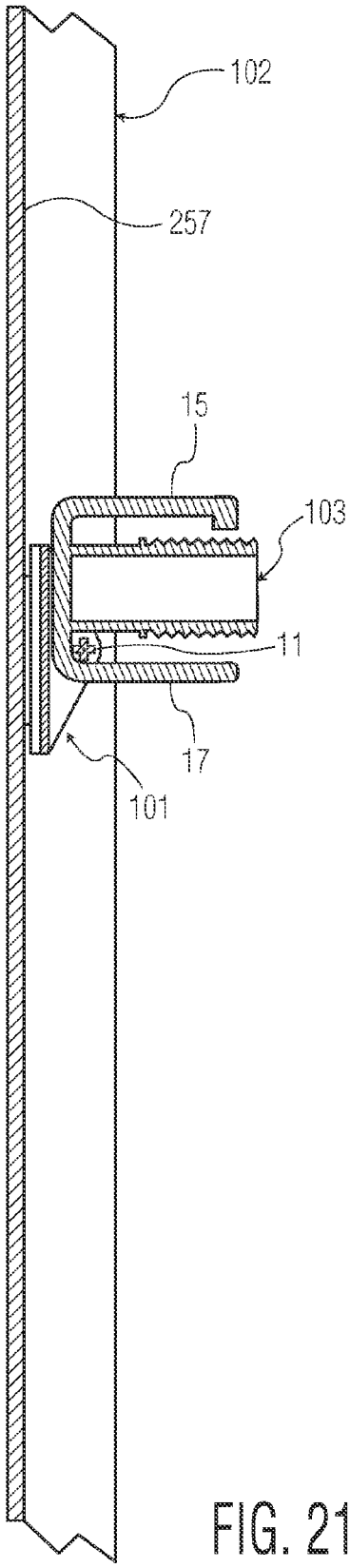
FIG. 21 is a partial cross sectional view of the mounting component rotated into a horizontal position on the mounting bracket in the patio door frame channel.
Figure 22:
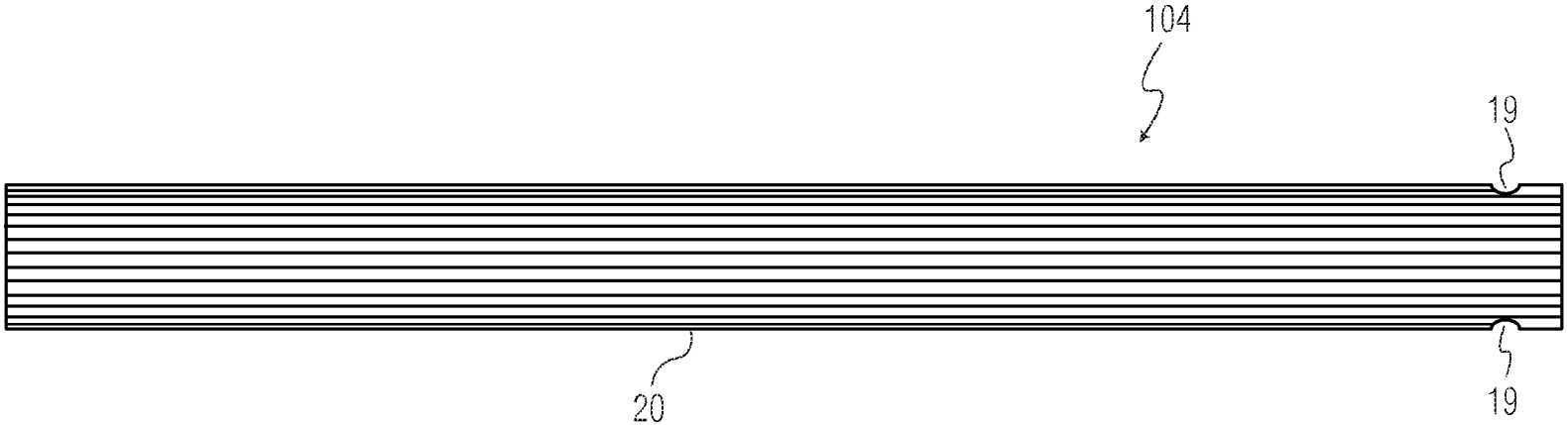
FIGS. 22 through 25 are right side view (left side view being a mirror image), back end view, top plan view (bottom plan view being identical) and front end view, respectively, of an adjustment barrel, for an embodiment of the invention.
Figure 23:
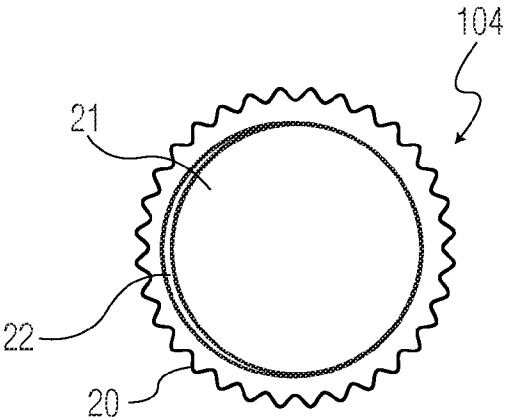
Figure 24:
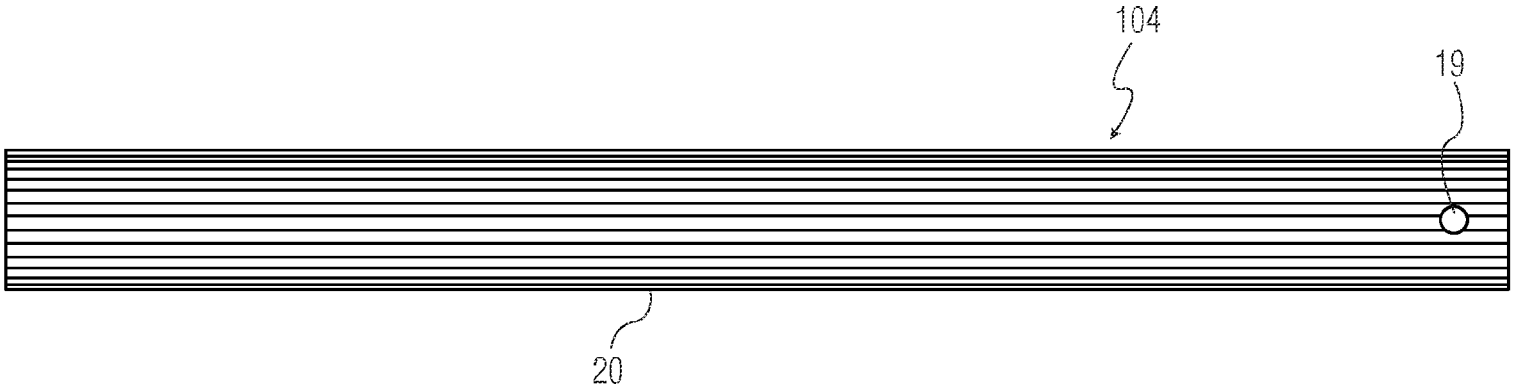
Figure 25:
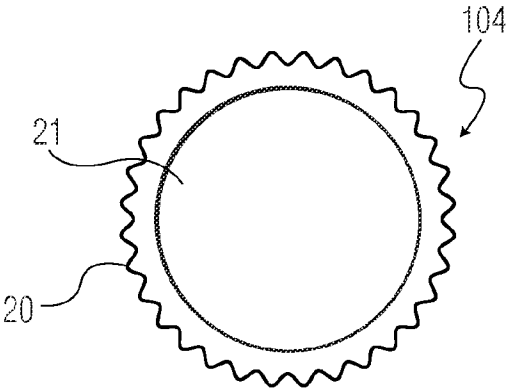

FIGS. 20 and 21 illustrate how threaded fine adjustment mounting component 103 is rotated about hinge bar 11 of mounting bracket 101 via mounting arm 17 of threaded fine adjustment mounting component 103 from a vertical resting position to a horizontal locking position shown by directional arrow 203.

An outer fine adjustment tube or barrel 104 is shown in FIGS. 22 through 25 right side (left side being identical) back end, top plan (bottom plan being identical) and front end views, respectively. Interior portion 21 of outer fine adjustment barrel 104 is designed to accept or receive an inner telescoping coarse or major adjustment tube or barrel 105 (see FIG. 31). In one embodiment of the present invention the outside diameter of the outer fine adjustment barrel 104 has longitudinal serrations 20 to serve as a grip and to engage drag tab 16 of threaded fine adjustment mounting component 103 (see FIGS. 14 and 15). This engagement is designed to create drag to prevent the outer fine adjustment barrel 104 from backing off of threaded fine adjustment mounting component 103 in use. An internal threaded portion 22 of outer fine adjustment barrel 104 permits threading of fine adjustment barrel 104 onto the threaded portion 14 of threaded fine adjustment mounting component 103 (see FIG. 15). The threaded engagement of the outer fine adjustment barrel 104 and threaded fine adjustment mounting component 103 allow the outer adjustment barrel 104 to be rotated clockwise or counter clockwise to create a finite telescoping adjustment of adjustable sliding door lock 111 to apply pressure to a retaining cup 107 (see FIGS. 36 through 39) attached to movable patio door 110, to prevent the latter from being opened with or without a pet door panel 112 installed. As barrel 104 is rotated in either a clockwise or counterclockwise direction the drag tab 16 lifts up via its drag arm 15, and then via the elastic memory of drag arm 16 snaps into the next occurring serration 20, making a clicking sound until such rotation is terminated.

Figure 26:
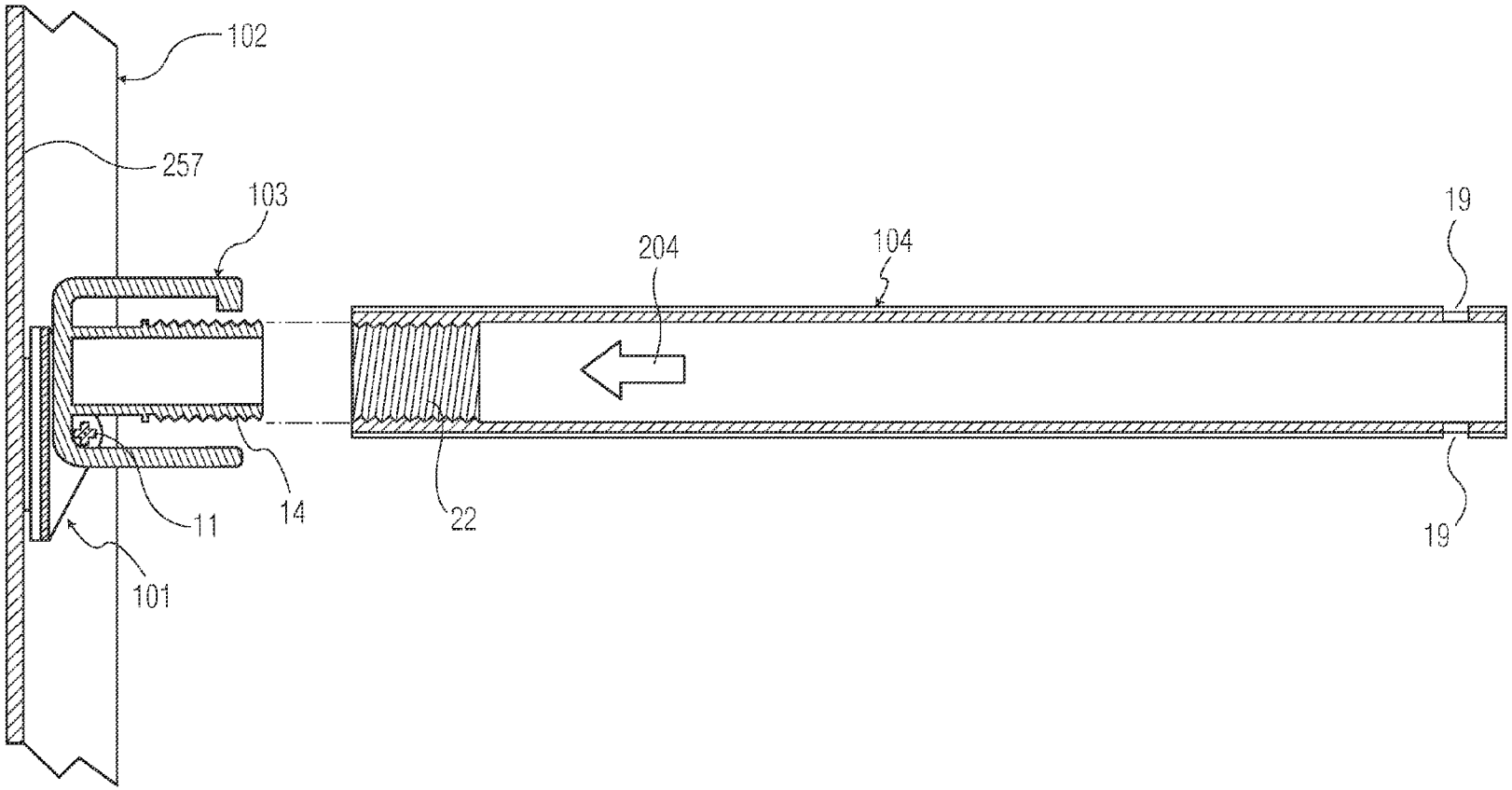
FIG. 26 is a partial longitudinal cross sectional exploded assembly view of the patio door lock outer fine adjustment barrel aligned for attachment to a cross sectional view of the mounting component taken along 26-26 of FIG. 14.
Figure 27A:
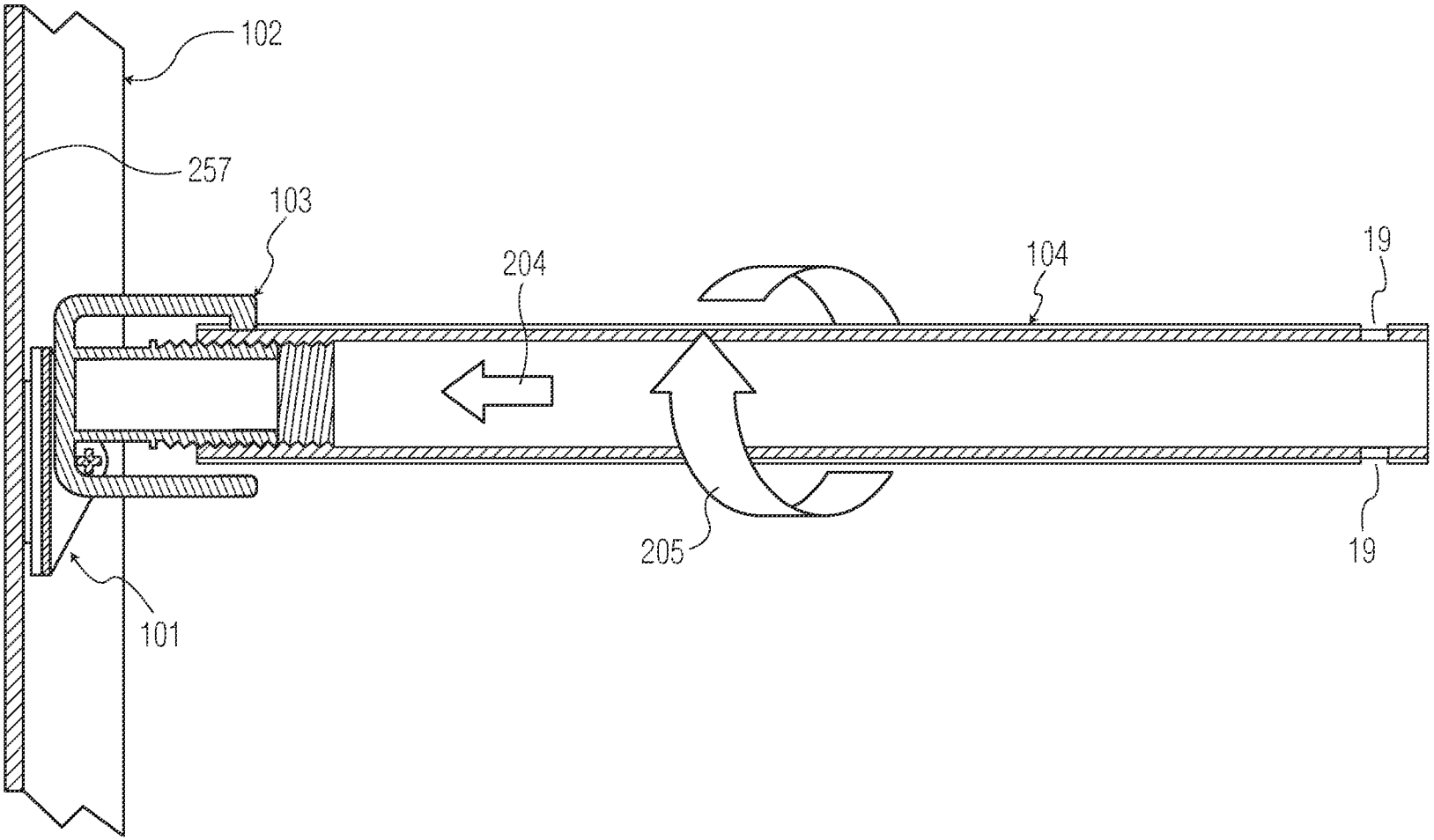
FIG. 27A is a partial longitudinal cross sectional view of the patio door lock outer fine adjustment barrel being threaded onto a cross sectional view of the mounting component taken along 26-26 of FIG. 14 installed on the mounting bracket installed in the patio door frame channel, for an embodiment of the invention.
Figure 27B:
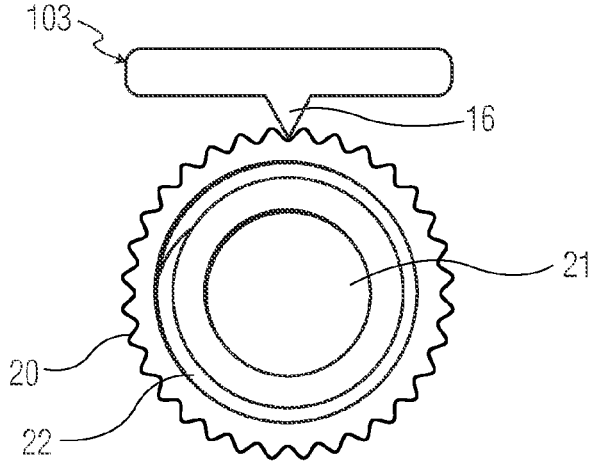
FIG. 27B is a partial end view showing the interconnection of a drag tab of the mounting component with a longitudinal serration of an outer fine adjustment barrel.

FIGS. 26 and 27A are partial cross sectional exploded assembly views of patio door frame 102, mounting bracket 101, threaded fine adjustment mounting component 103, and outer fine adjustment barrel 104. These figures illustrate the threaded attachment of outer fine adjustment barrel 104 to threaded fine adjustment mounting component 103 as shown by directional arrows 204 and 205. As shown in FIG. 27B, drag tab 16 of mounting component 103 engages the serrated portion 20 of barrel 104, and normally is seated between pairs of the serrations of serrated portion 20. As barrel 104 is turned clockwise or counterclockwise, drag arm 15 is resilient and moves upward lifting drag tab 16 as barrel 104 is rotated. When the next pair of serrations is reached, drag arm 15 moves downward causing drag tab 26 to seat between the next pair of serrations. In this manner, drag 16 snaps into position between each successive pair of serrations, thereby permitting fine adjustment of the inward or outward positioning of barrel 104 on threaded position 14 of mounting component 103.

Figure 28:
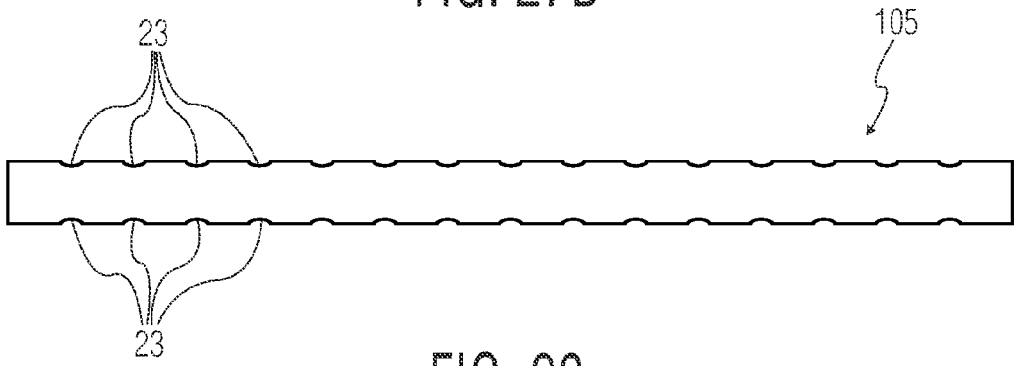
FIGS. 28, 29 and 30 are a right side view (left side being identical), top plan view (bottom plan view being identical), and front end view (back end view being identical), respectively, of a patio door lock inner telescoping major adjustment barrel, for an embodiment of the invention.
Figure 29:
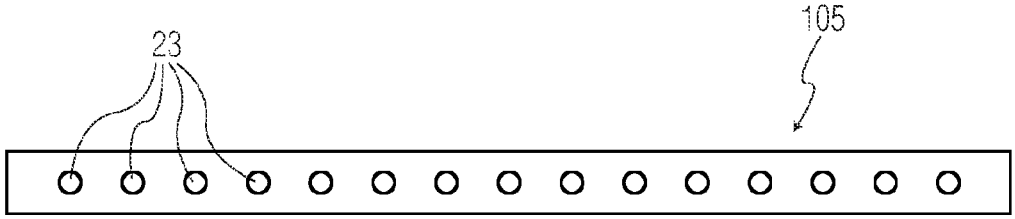
Figure 30:
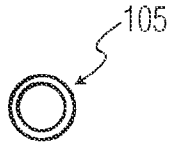

An inner telescoping major adjustment barrel 105 is shown in right side (left side being identical), top plan (bottom plan being identical), and front end (back end being identical) views, in FIGS. 28 through 30, respectively. Major adjustment locking pin through holes 23 are located at intervals along barrel 105 of inner telescoping major adjustment barrel 105. These major adjustment locking pin holes 23 are designed to accept a locking pin 106 (see FIGS. 33, 34A, and 34B) that passes through locking pin holes 19 in outer fine adjustment barrel 104 (see FIGS. 22 and 24) and major adjustment locking pin holes 23 in inner telescoping major adjustment barrel 105. In so doing, inner telescoping major adjustment barrel 105 within outer fine adjustment barrel 104 when extended to the proper distance to engage the patio door frame 102 and the retaining cup 107 in movable patio door 110 of sliding glass patio door 113 is locked in place in outer fine adjustment barrel 104 of adjustable sliding door lock 111.

Figure 31:
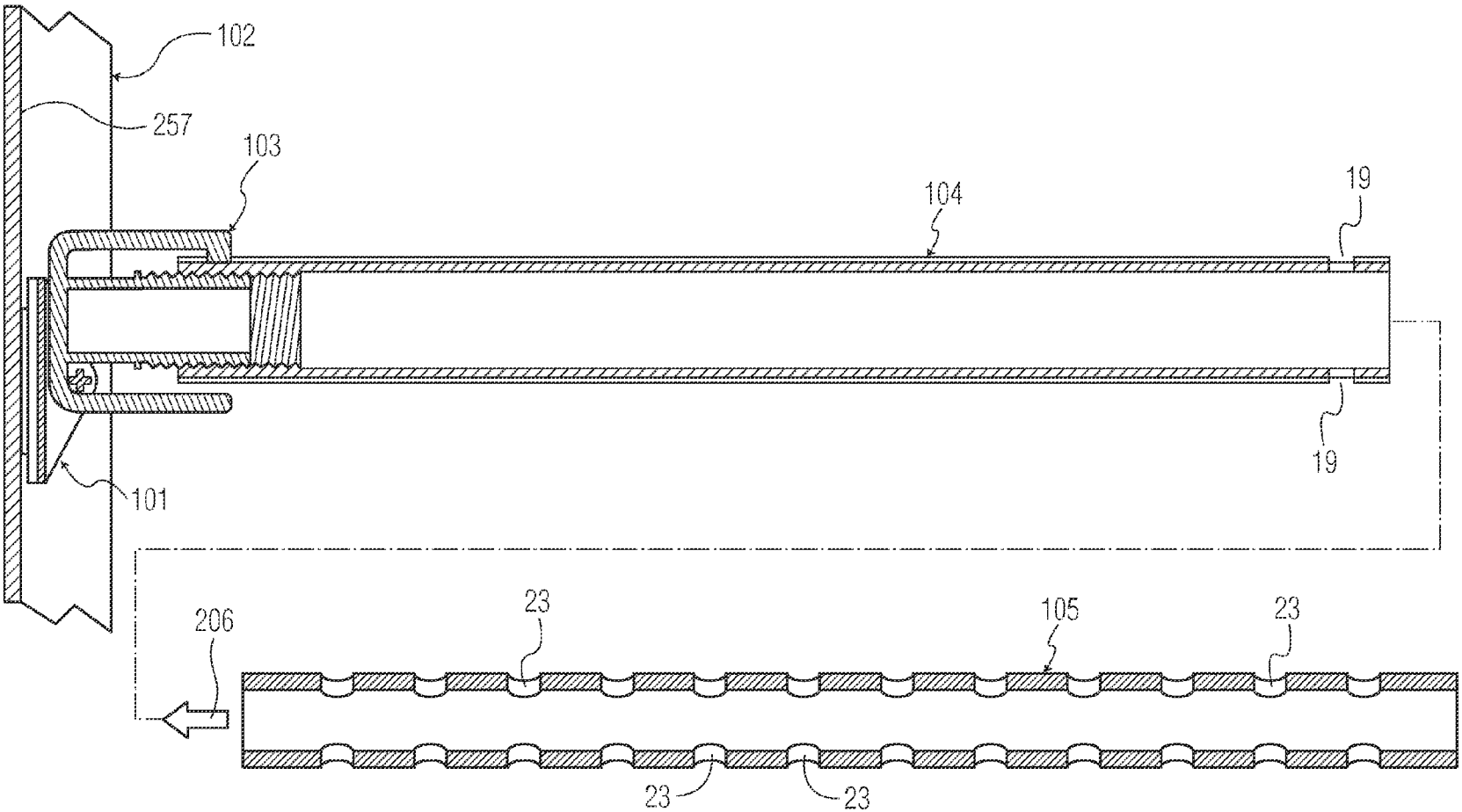
FIG. 31 is a partial longitudinal cross sectional exploded assembly view of the patio door lock inner telescoping major adjustment barrel aligned for installation into the patio door lock outer fine adjustment barrel installed on the patio door lock mounting component installed on the mounting bracket installed in the patio door frame channel, for an embodiment of the invention.

FIG. 31 is a partial longitudinal cross sectional exploded assembly view where directional arrow 206 shows the insertion of inner telescoping major adjustment barrel 105 into outer fine adjustment barrel 104.

Figure 32:
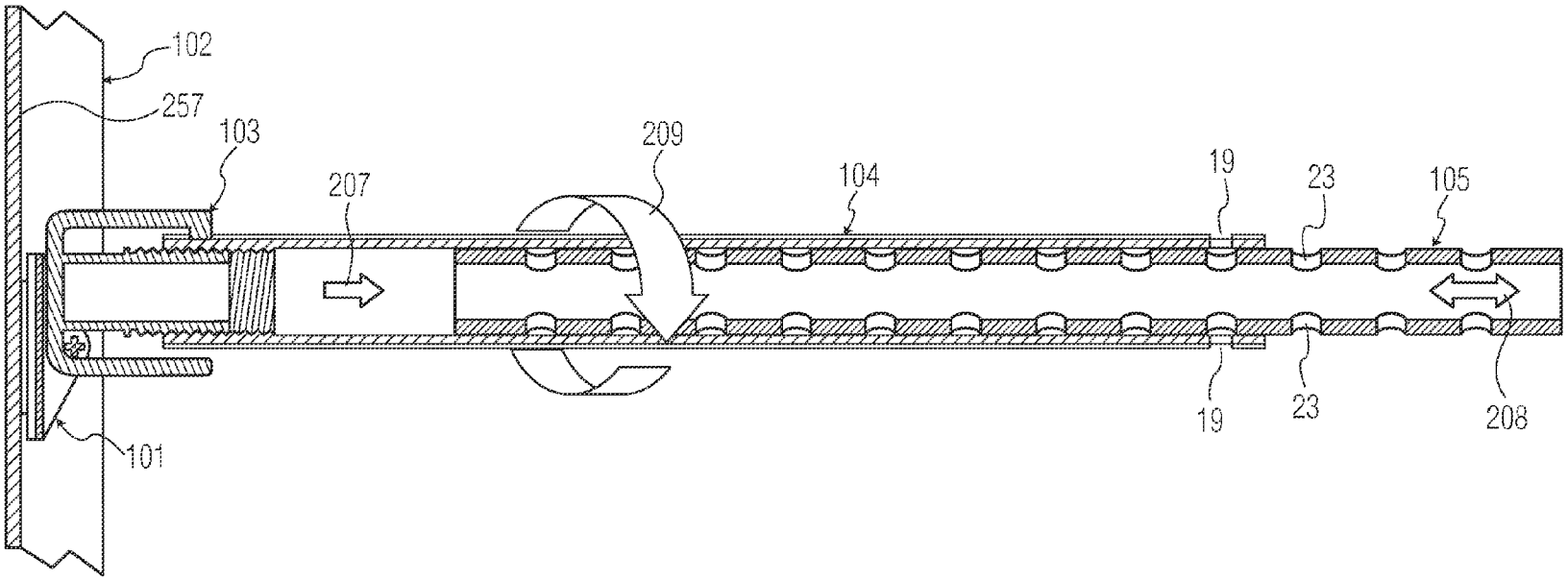
FIG. 32 is a partial longitudinal cross sectional view of the assembled patio door lock showing the process of adjusting to a desired overall length the outer fine adjustment barrel and inner telescoping major adjustment barrel, for an embodiment of the invention.

FIG. 32 is a partial longitudinal cross sectional view showing the adjustment process of rotating outer fine adjustment barrel 104 unscrewing it from threaded fine adjustment component 103 as indicated by directional arrows 207 and 209. Directional arrow 208 shows the movement of inner telescoping major adjustment barrel 105 within outer fine adjustment barrel 104.

Figure 34B:
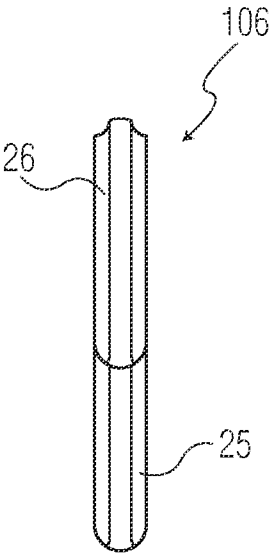
FIGS. 33, 34A, and 34B are front (back view being mirror image right side and left side views, respectively, of an inner telescoping major adjustment barrel locking pin, for an embodiment of the invention.
Figure 34A:
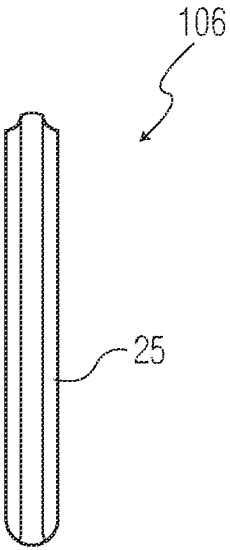
Figure 33:
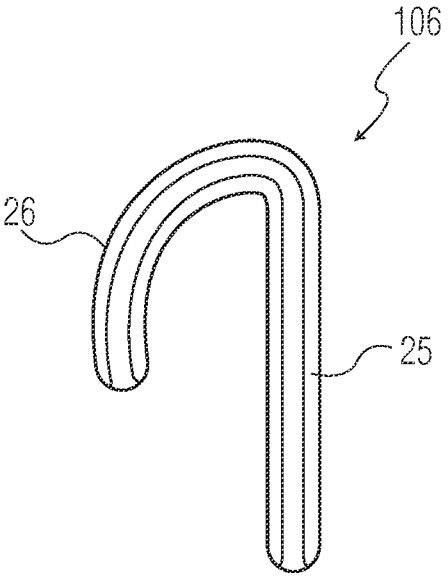
Figure 35:
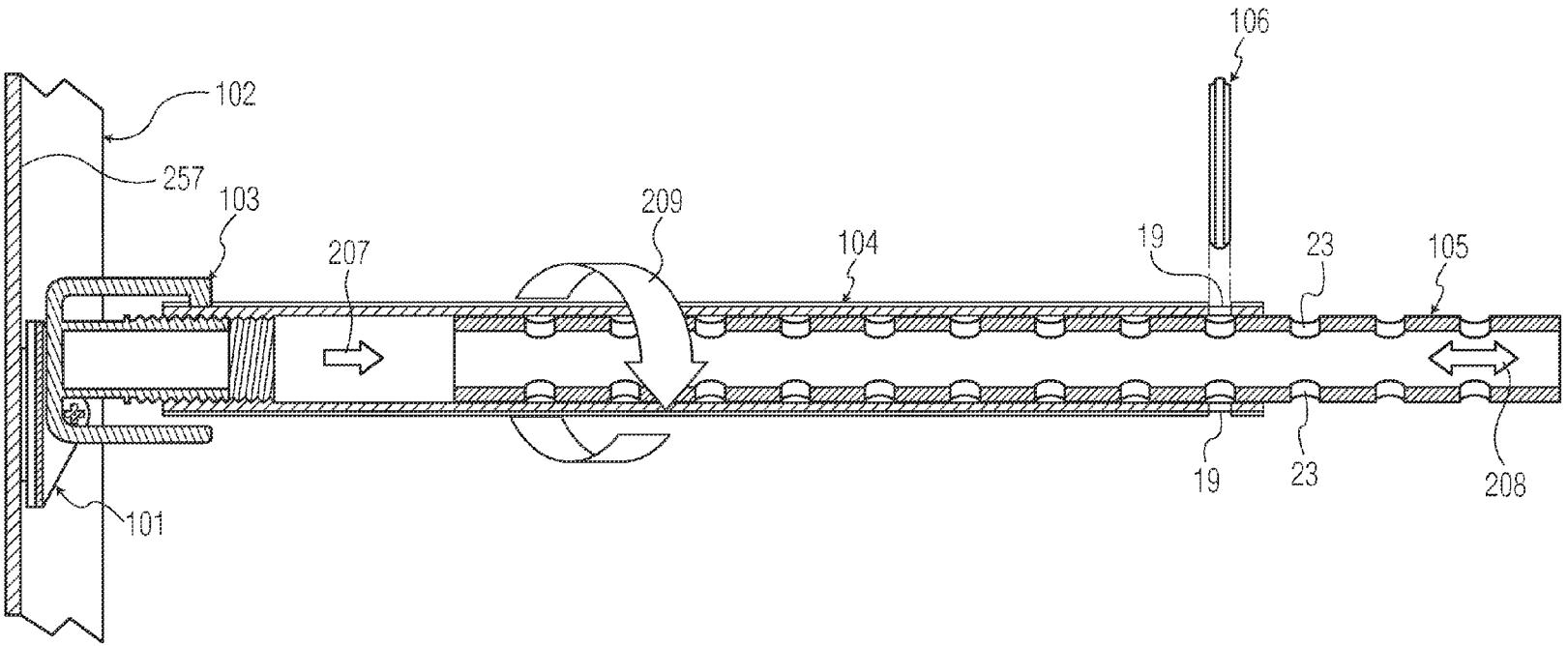
FIG. 35 is a partial longitudinal cross sectional view of the present assembled patio door lock showing the process of adjusting the overall length between the outer fine adjustment barrel relative to the inner telescoping major adjustment barrel, and inserting the inner telescoping major adjustment barrel locking pin, for an embodiment of the invention.

Locking pin 106 is shown in FIGS. 33, 34A, and 34B front (back view being mirror image), right side, and left side views, respectively. Locking pin shaft 25 is inserted into and through opposing holes 19 of outer fine adjustment barrel 104, and holes 23 of inner major adjustment barrel 105 (see FIG. 35). Retaining arm 26 of locking pin 106 is designed to fit securely over and partially around outer fine adjustment barrel 104 to prevent locking pin 106 from falling out of adjustable sliding door lock 111. FIG. 35 is a partial longitudinal cross sectional exploded assembly view showing locking pin 106 aligned for insertion into adjustable sliding door lock 111, as described.

Figure 37B:
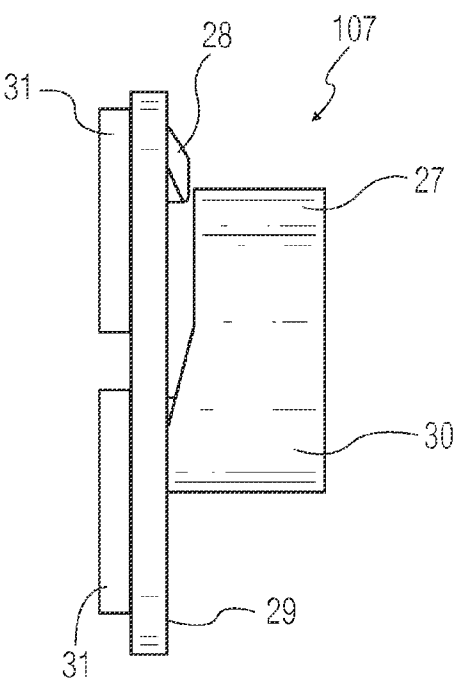
FIGS. 36, 37A, and 37B are a pictorial view from the front, and front and left side elevational views (right side being mirror image), respectively, of an inner telescoping major adjustment barrel retaining cup, for an embodiment of the invention.
Figure 37A:
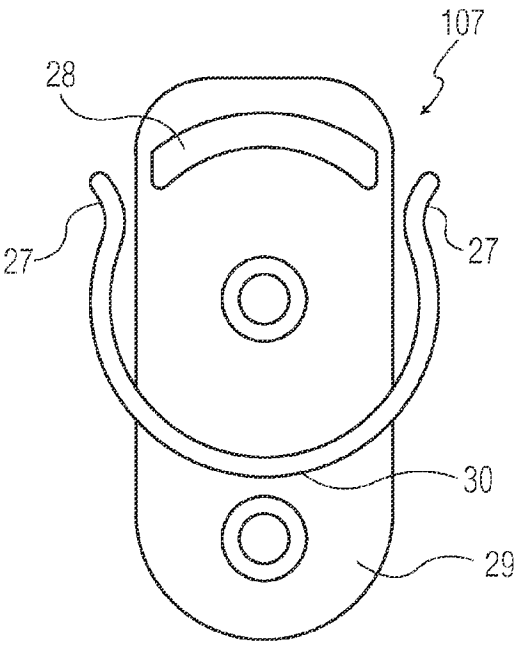
Figure 36:
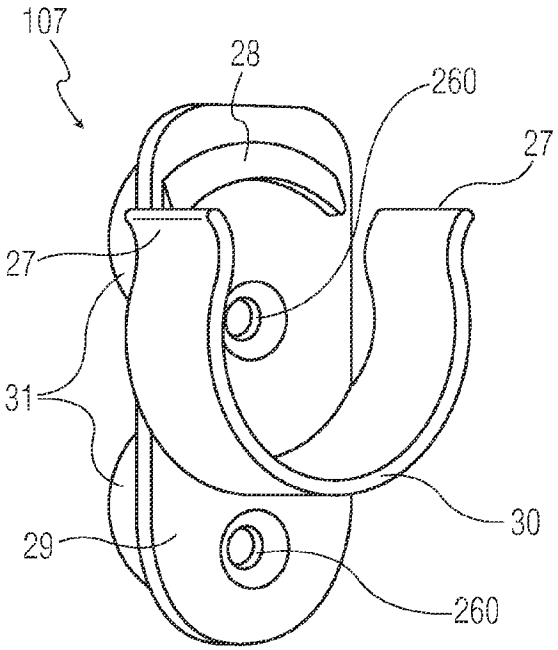

FIGS. 36, 37A, and 37B are pictorial front elevational, and left side elevational (right side being a mirror image) views, respectively, of the retaining cup 107. The geometry of retention horns or tabs 27 serve as a spring type clamp and with their lower semicircular portion 30 are operable to retain an end portion of the inner telescoping major adjustment barrel 105 in place when adjustable sliding door lock 111 is being positioned to lock and unlock the movable patio door 110. An adhesive strip 31 applied to the back of backing plate 29, as shown in FIG. 37B, attaches retaining cup 107 to the movable sliding patio door 110 or to the patio door frame 102 depending upon the type of installation. Also, holes 260 are provided in backing plate 29 to permit it to be screw mounted, rather than mounted via adhesive strip or pad 31. An arc-like protruding stud or boss 28 in an upper portion of the front of backing plate 29 facilitates retaining the end portion of barrel 105 in place by preventing upward movement thereof after installation in retaining end cup 107.

Figure 38:
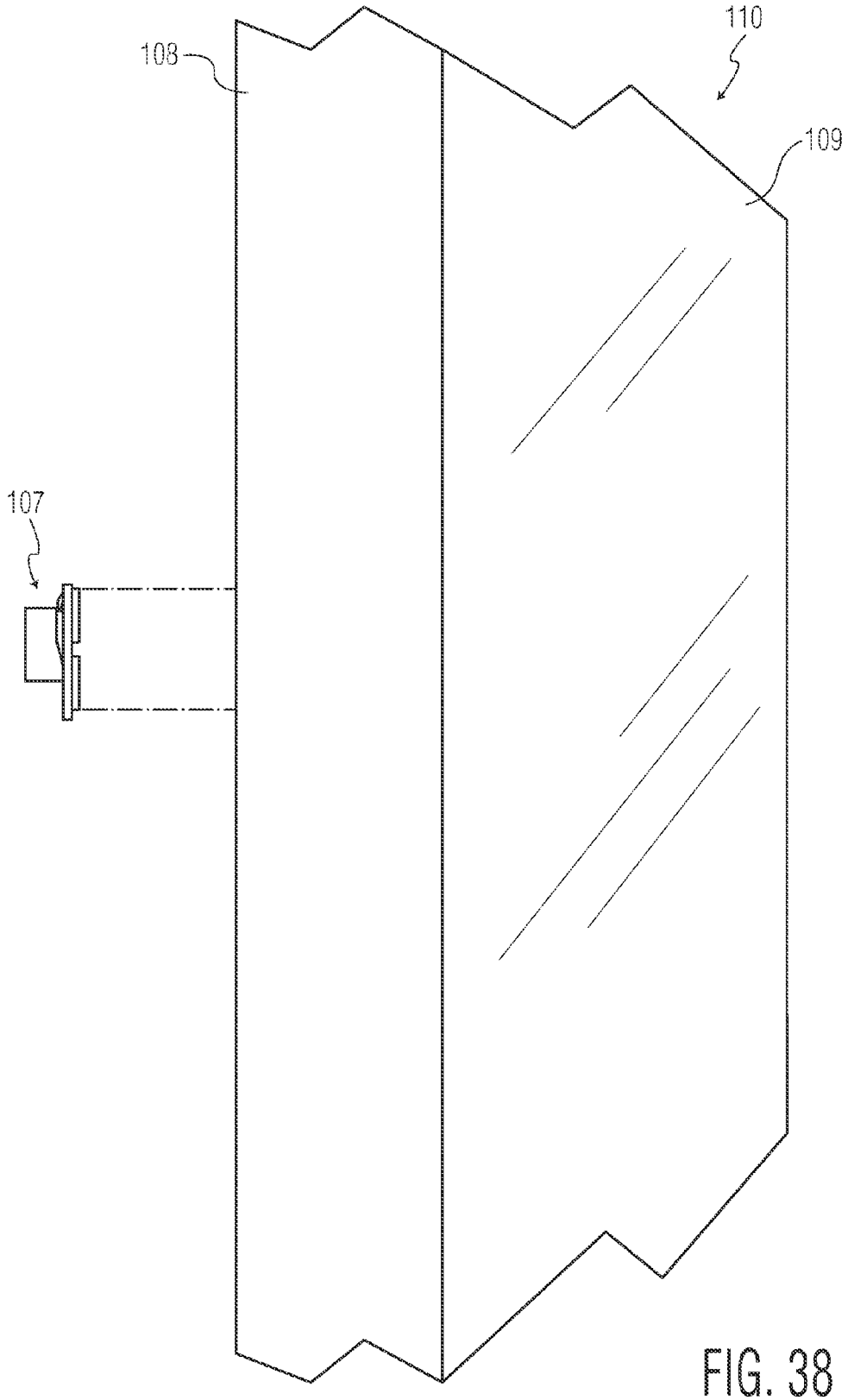
FIG. 38 is a partial exploded assembly view of the inner telescoping major adjustment barrel retaining cup positioned for attachment to the trailing edge of the movable patio door, for an embodiment of the invention.

FIG. 38 is a partial exploded assembly view of retaining cup 107 and movable sliding patio door frame 108 of movable sliding patio door 110.

Figure 39:
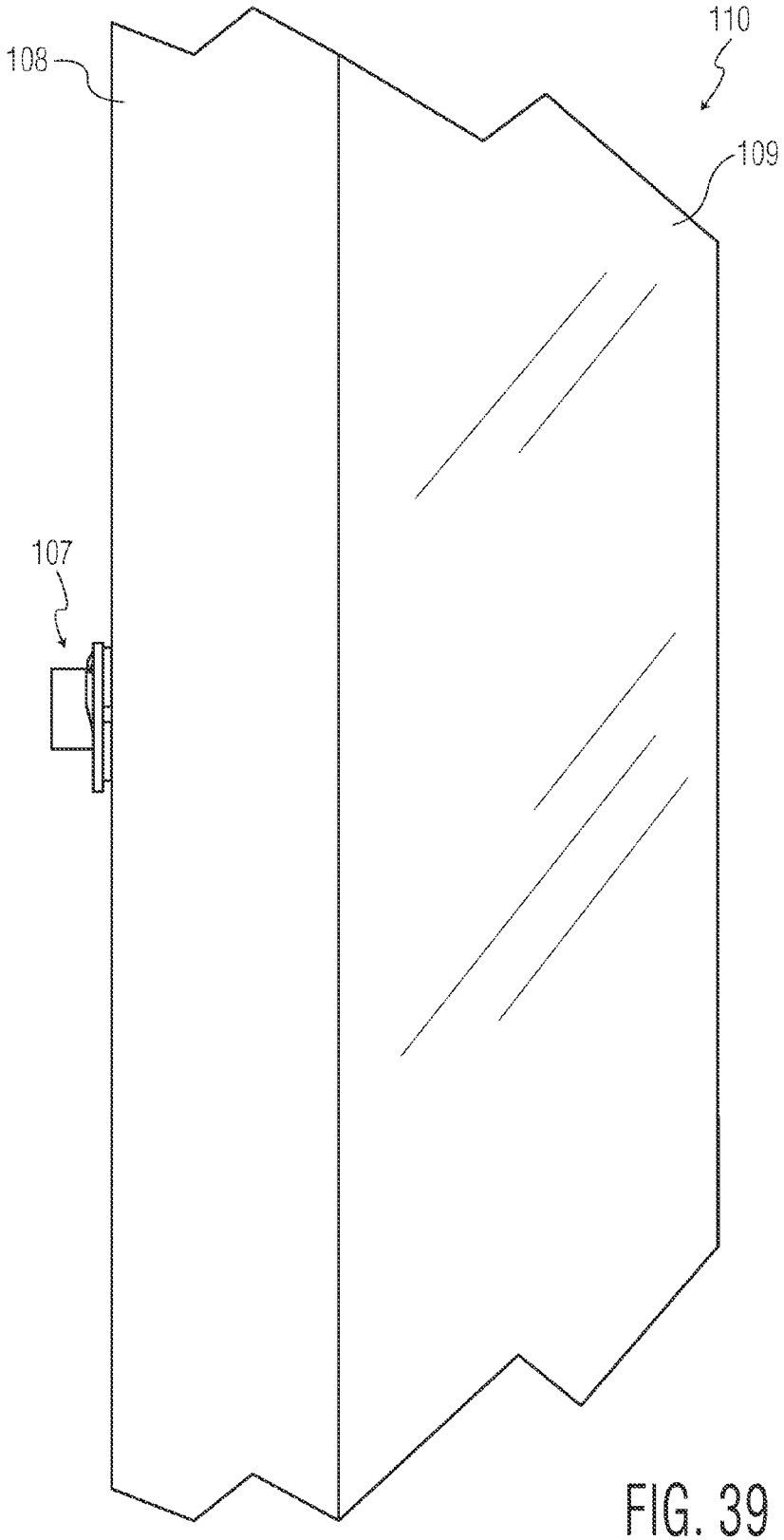
FIG. 39 is a partial longitudinal view of the inner telescoping major adjustment barrel retaining cup attached to the trailing edge of the movable patio door, for an embodiment of the invention.

FIG. 39 shows retaining cup 107 attached to movable sliding patio door frame 108 of movable sliding patio door 110.

Figure 40:
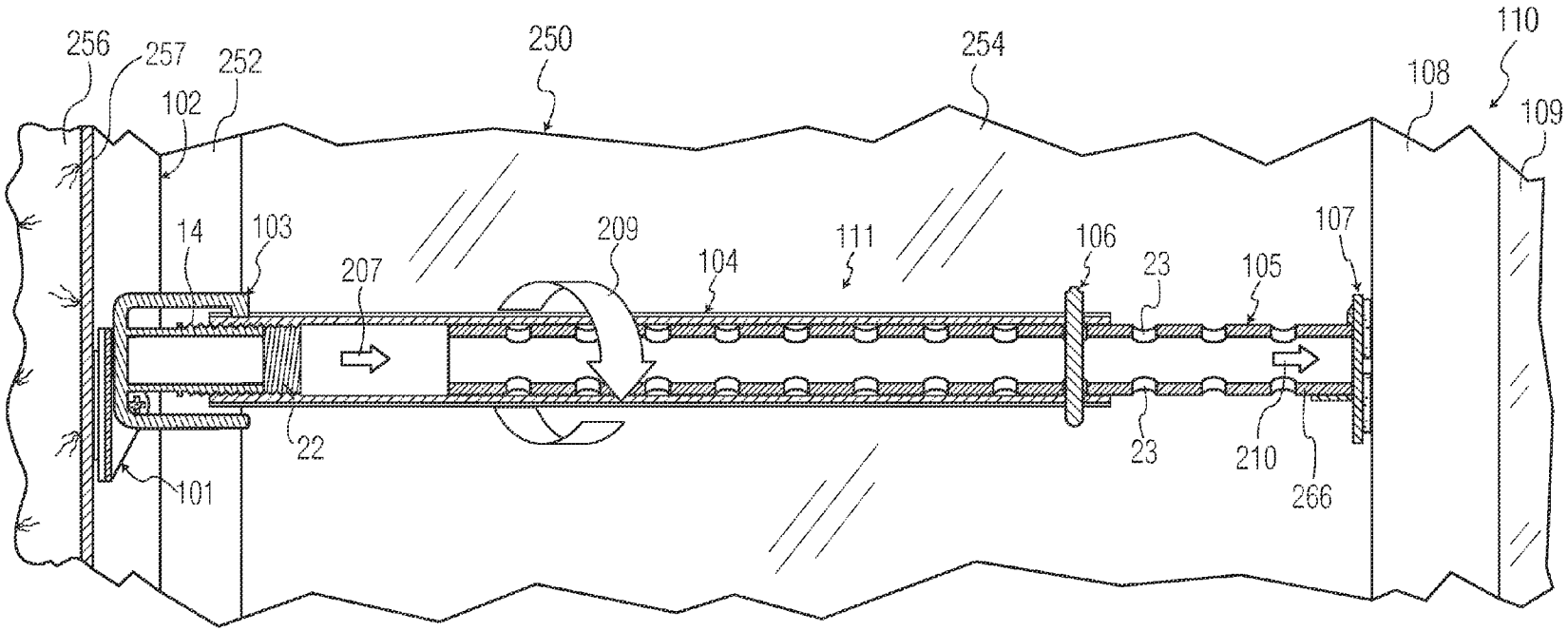
FIG. 40 is a partial longitudinal cross sectional view showing adjustment of the patio door lock to lock a movable patio door in place, for an embodiment of the invention.

In FIG. 40, a wall portion 256 is shown to which frame 102 of patio door 113 is attached. FIG. 40 illustrates adjusting the adjustable sliding door lock 111, wherein it is in a horizontal locking position, and outer fine adjustment barrel 104 is rotated as shown by directional arrow 209, for causing its threaded portion 22 in threaded engagement with threads 14 of fine adjustment mounting component 103 to unscrew extending the outer fine adjustment barrel 104 in the direction shown by directional arrow 207. This action pushes the free end 266 of inner major adjustment barrel 105 to be extended in the direction indicated by directional arrow 210 to secure it tightly into retaining cup 107. This action insures lock 111 fits securely in the space between patio door frame 102 and retaining cup 107 attached to movable sliding patio door stile 108 of movable sliding patio door 110, as previously described. With inner major adjustment barrel 105 locked in place within outer fine adjustment barrel 104 by locking pin 106, a constant pressure is applied to movable sliding patio door 110 by lock 111 for holding lock 111 securely in place between the patio door frame 102 and stile 108.

Figure 41:
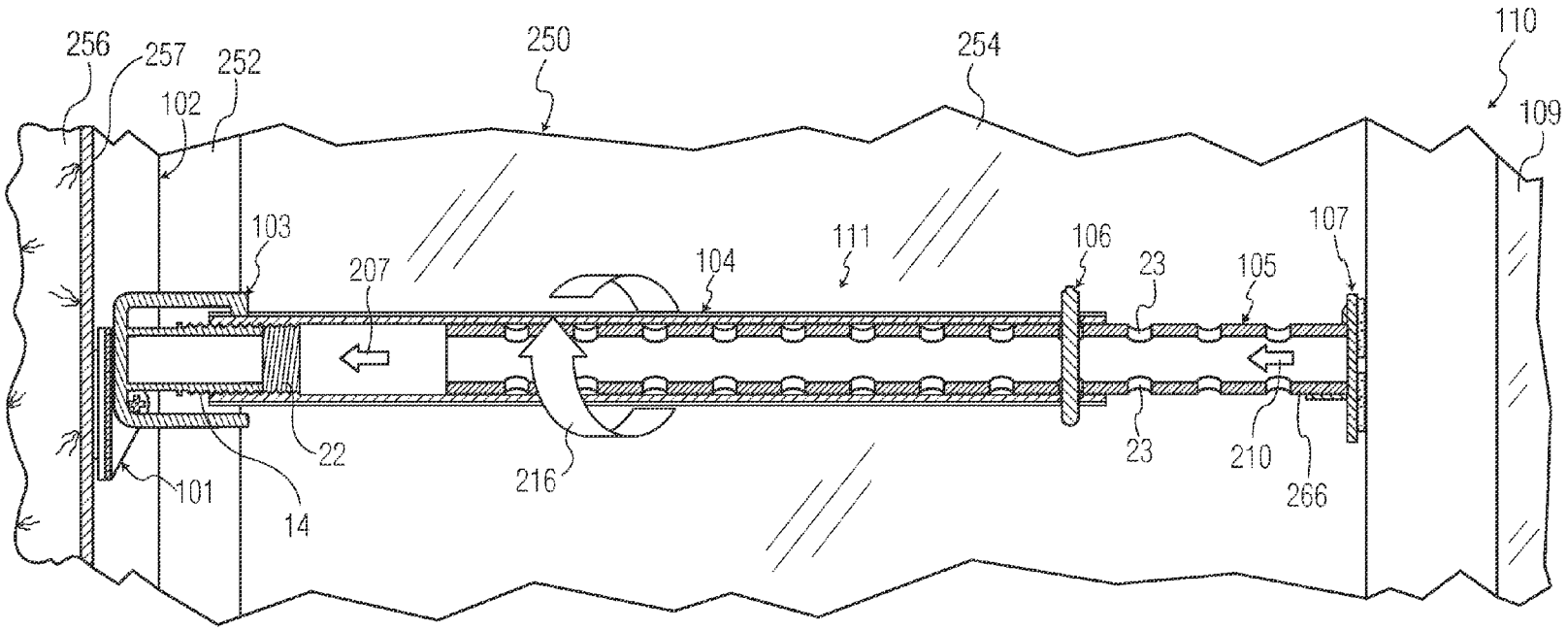
FIG. 41 is a partial longitudinal cross sectional view showing adjustment of the patio door lock to unlock the movable patio door, for an embodiment of the invention.

FIG. 41 illustrates adjusting sliding door lock 111, wherein outer fine adjustment barrel 104 is rotated as indicated by directional arrow 216, while the unit is in a horizontal locking position. This action causes outer fine adjustment barrel 104 to screw onto threaded fine adjustment mounting component 103 via threaded engagement moving outer fine adjustment barrel 104 and inner telescoping major adjustment barrel 105 in the direction indicated by directional arrow 211 away from stile 8 of movable sliding patio door 110. In so doing adjustable sliding door lock 111 can be lifted out or retaining cup 107 on movable patio door stile 108 as shown in FIG. 42.

Figure 42:
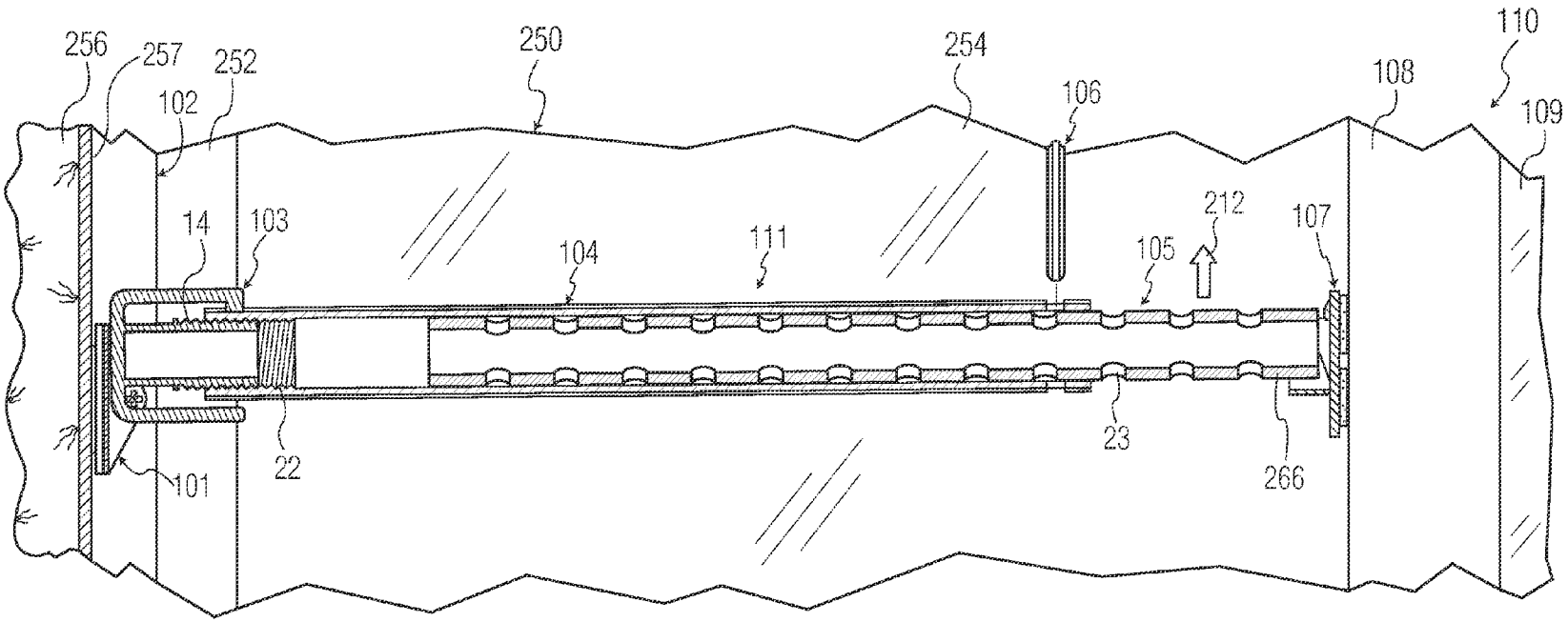
FIG. 42 is a partial longitudinal cross sectional view showing the patio door lock being lifted out of the inner telescoping major adjustment barrel retaining cup located on the movable patio door, for an embodiment of the invention.

Directional arrow 212 in FIG. 42 indicates lifting of adjustable sliding door lock 111 out of retaining cup 107.

Figure 43:
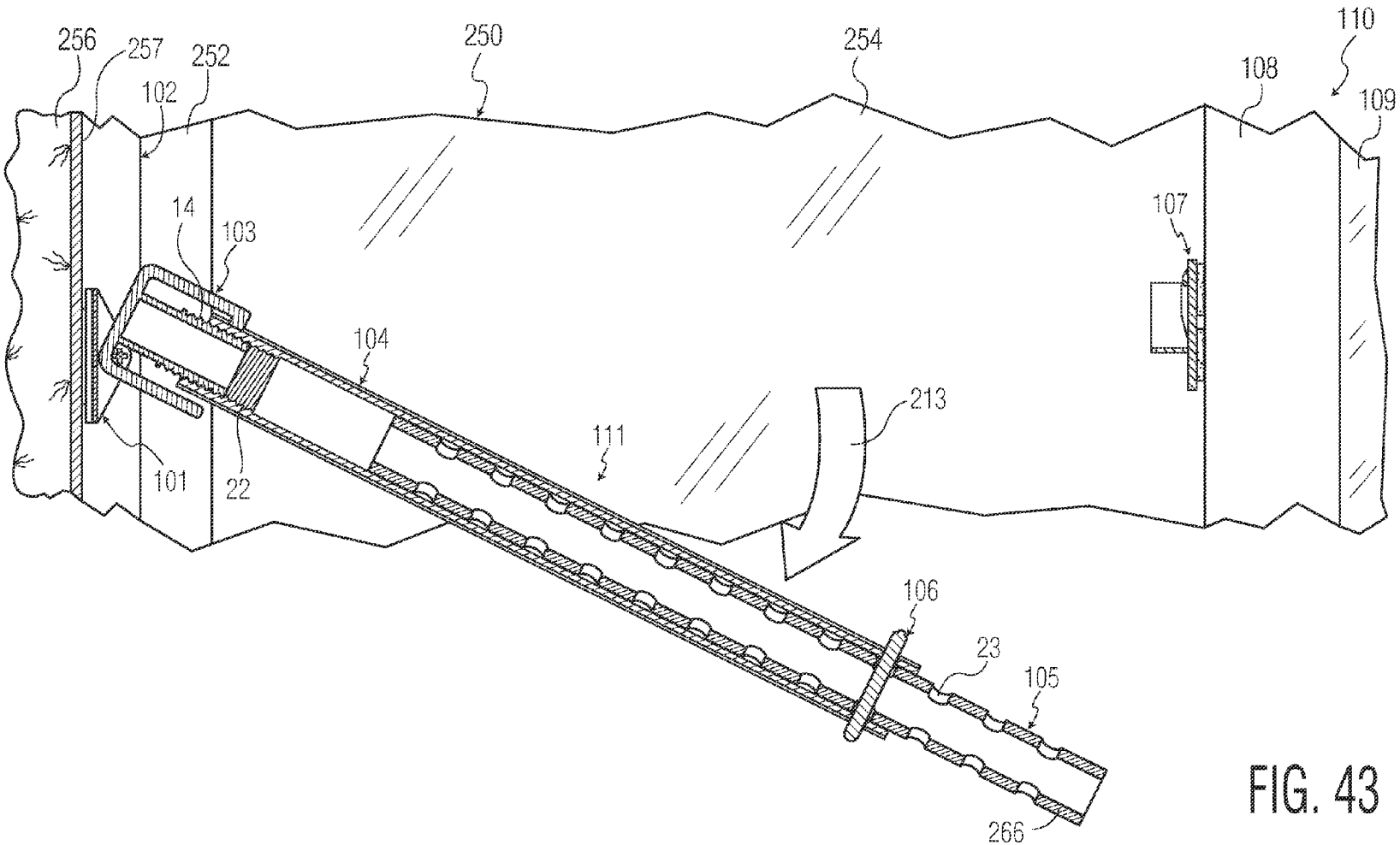
FIG. 43 is a partial longitudinal cross sectional view showing the patio door lock being lowered into a resting unlocked position, with opening of the patio door, for an embodiment of the invention.

FIG. 43 shows adjustable sliding door lock 111 being lowered on mounting bracket 101 in patio door frame 102 in the direction indicated by directional arrow 213.

Figure 44:
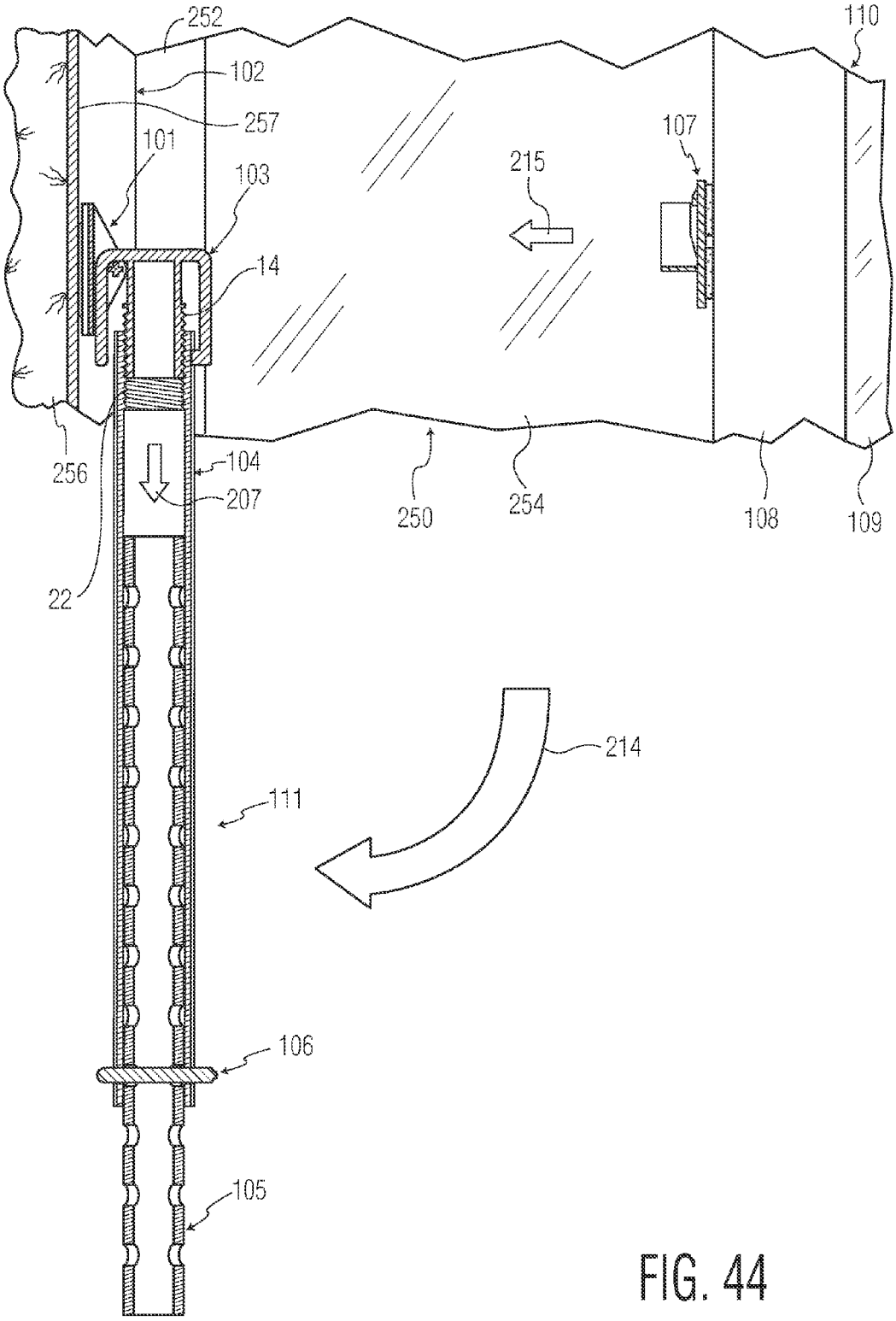
FIG. 44 is a partial longitudinal cross sectional view showing the patio door lock in the resting unlocked position and opening of the movable patio door.

FIG. 44 shows adjustable sliding door lock 111 at rest in an unlocked vertical position suspended from mounting bracket 101 in patio door frame 102 after being fully lowered as indicated by directional arrow 214. Movable sliding patio door 110 may then be opened as indicated by directional arrow 215 to allow passage of people or animals, or to remove or install a pet door panel 112.

Although various embodiments of the invention have been shown and described, they are not meant to be limiting. Those of skill in the art may recognize certain modifications to these embodiments, which modifications are meant to be covered by the spirit and scope of the appended claims. For example, in an alternative embodiment of the invention, the mounting bracket 101 can be secured on the frame 108 of the movable door, and the retaining cup 107 secured on the fixed frame 102, thereby reversing the installation of the adjustable sliding door or window lock 111 therebetween. Also, the inner telescoping major adjustment barrel 105 can either be a solid rod or tubular as shown with a hollow cavity between its ends. In addition the longitudinal serrations 20 on the outside or exterior portion of said outer fine adjustment barrel 104 to not have to extend the entire length thereof, and need only extend from the threaded end thereof to the extent necessary to insure reliable engagement with drag tab 16 of mounting component 103. Also, the components of the present invention can be provided by an appropriate material, such as metal and/or plastic materials. Note also that it is expected that the sliding door lock 111 will be sold fully assembled with all components attached together, thereby providing a user with the ability to simply secure the mounting bracket 100 to the patio door frame 102, and the retaining cup 107 to the stile or frame 108 of the movable sliding patio door 110, or vice versa. Accordingly, no other assembly is required by the user.

What is claimed is:

1. A portable length adjustable wedge device for locking any of a sliding door, a sliding panel, a sliding window, and a sliding patio door, said device comprising:

an elongated first barrel having first and second ends;

an elongated second having first and second ends, said first and second barrels being relatively dimensioned to provide for at least a portion of said second barrel to be slideably received in an interior portion or cavity of said first barrel;

said first barrel being configured to receive at its second end said first end of said second barrel, for permitting a portion of said second barrel to be slid into said first barrel;

means for incrementally adjusting and fixing the length of said second barrel within said first barrel to attain an initial desired overall length between said first barrel and the extension therefrom of said second barrel, the overall length providing for extended ends of said first and second barrels to fit loosely between a stationary frame of said door or window and an opposing movable frame of a movable portion of said door or window;

means for securing said second end of said second barrel in a freely rotatable manner while at a fixed position, either one of attached or mounted or connected to one of said stationary frame or said movable frame, on a longitudinal axis, whereby the longitudinal axis is a common axis, in a longitudinal direction, along the center of both the first and second barrels; and fine adjustment means securing the first end of said first barrel to the other one of said stationary frame or movable frame, said fine adjustment means and the first end of said first barrel being inter-cooperatively adapted for permitting rotation in unison of said first and second barrels in one direction to smoothly extend the overall length thereof, in a non-incremental manner, to rigidly secure said device between the opposing stationary and movable frames of said door or window to lock an associated movable member in a closed position, and the aforesaid rotation in an opposite direction for unlocking the movable member.

2. The device of claim 1, wherein said means for incrementally adjusting the overall length between said first and second barrels includes:

said first barrel having opposing through holes between its first and second ends;

said second barrel including a plurality of spaced apart through holes between its first and second ends; and a locking pin, whereby when the first end of said second barrel is inserted into the second end of said first barrel, a desired position of said second barrel is slid into said first barrel, and positioned with the opposing through holes of said first and second barrels in alignment for obtaining said desired initial overall length therebetween, whereafter said locking pin is inserted into the aligned through holes of said first and second barrels for locking them together.

3. The device of claim 1, wherein said fine adjustment means includes:

a portion of the cavity proximate the first end of said first barrel having a plurality of female threads; and a mounting component secured to the one of said stationary frame or movable frame associated with the first end of said first barrel, said mounting component including protruding from a central portion of an inner back segment a male threaded stud configured for threadably engaging the female threaded portion of the first end of said first barrel.

4. The device of claim 2, wherein said fine adjustment means includes:

a portion of the cavity proximate the first end of said first barrel having a plurality of female threads; and a mounting component secured to the one of said stationary frame or movable frame associated with the first end of said first barrel, said mounting component including protruding from a central portion of an inner back segment a male threaded stud configured for threadably engaging the female threaded portion of the extended end of said first barrel.

5. The device of claim 3, further including:

said first barrel being circular, and having a plurality of axially directed longitudinal serrations successively juxtaposed on at least a portion of an exterior or outside surface thereof; and said mounting component further including releasable retention means for engaging one of said plurality of axially directed longitudinal serrations, for firmly retaining a desired positioning between said male threaded stud and the female threaded portion of said first barrel.

6. The device of claim 2, further including:

a portion of the cavity proximate the first end of said first barrel having a plurality of female threads;

a mounting component secured to the one of said stationary frame or movable frame associated with the first end of said first barrel, said mounting component including protruding from a central portion of an inner back segment a male threaded stud configured for threadably engaging the female threaded portion of the first end of said first barrel;

said first barrel being circular, and having a plurality of axially directed longitudinal serrations successively juxtaposed on at least a portion of an exterior or outside surface thereof; and said mounting component further including releasable retention means for engaging one of said plurality of axially directed longitudinal serrations, for firmly retaining a desired positioning between said male threaded stud and the female threaded portion of said first barrel.

7. The device of claim 5, wherein said releasable retention means includes:

a resilient drag arm having elastic memory, extending from a top edge of said inner back segment of said male threaded stud, and being parallel to a threaded portion of said male threaded stud; and a drag tab projecting from said drag arm and configured for firmly engaging one of said plurality of axially directed longitudinal serrations, whereby as said first barrel is rotated, said drag arm lifts up to permit said drag tab to disengage from an associated serration and then snap into a next occurring serration in an iterative manner, until rotation of said first barrel is terminated.

8. The device of claim 6, wherein said releasable retention means includes:

a resilient drag arm having elastic memory, extending from a top edge of said inner back segment, and being parallel to said threaded stud;

a drag tab projecting from said drag arm and configured engaging one of said plurality of axially directed longitudinal serrations, whereby as said first barrel is rotated, said drag arm lifts up to permit said drag tab to disengage from an associated serration and then snap into a next occurring serration in an iterative manner, until rotation of said first barrel is terminated.

9. The device of claim 7, further including:

a mounting bracket firmly secured to the one of said stationary frame or movable frame associated with the first end of said first barrel;

said mounting bracket including a mounting hinge bar;

said mounting component further including a mounting arm extending from a bottom edge of said inner back segment and being parallel to said threaded stud on an opposite side thereof relative to said drag arm;

said mounting hinge bar being configured for receiving said mounting arm;

said mounting arm being configured for mounting on said mounting hinge bar to either permit said first barrel and attached second barrel when inoperative to hang downward from said mounting hinge, and when operative to extend between said fixed and movable frames.

10. The device of claim 8, further including:

a mounting bracket firmly secured to the one of said stationary frame or movable frame associated with the first end of said first barrel;

said mounting bracket including a mounting hinge bar;

said mounting component further including a mounting arm extending from a bottom edge of said inner back segment and being parallel to said threaded stud on an opposite side thereof relative to said drag arm;

said mounting hinge bar being configured for receiving said mounting arm;

said mounting arm being configured for mounting on said mounting hinge bar to either permit said first barrel and attached second barrel when inoperative to hang downward from said mounting hinge, and when operative to extend between said fixed and movable frames.

11. The device of claim 1, wherein said securing means includes:

a retaining cup rigidly secured to the one stationary frame or movable frame associated with the second end of said second barrel, said retaining cup being configured for receiving and retaining the second end of said second barrel.

12. The device of claim 11 wherein said retaining cup further includes:

a lower semicircular portion; and a pair of opposing spaced apart retaining tabs projecting upward from said semicircular portion, said retaining tabs being configured to permit the second end of said second barrel to be snapped into and retained in said semicircular portion.

13. The device of claim 3, wherein said securing means includes:

a retaining cup rigidly secured to the one stationary frame or movable frame associated with the second end of said second barrel, said retaining cup being configured for receiving and retaining the second end of said second barrel.

14. The device of claim 13, wherein said retaining cup further includes:

a lower semicircular portion; and a pair of opposing spaced apart retaining tabs projecting upward from said semicircular portion, said retaining tabs being configured to permit the second end of said second barrel to be snapped into and retained in said semicircular portion.

15. The device of claim 5, wherein said securing means includes:

a retaining cup rigidly secured to the one stationary frame or movable frame associated with the second end of said second barrel, said retaining cup being configured for receiving and retaining the second end of said second barrel.

16. The device of claim 15, further including:

a lower semicircular portion; and a pair of opposing spaced apart retaining tabs projecting upward from said semicircular portion, said retaining tabs being configured to permit the second end of said second barrel to be snapped into and retained in said semicircular portion.

17. An adjustable lock for use with any sliding door, sliding panel, or sliding window where a wedge type closure will help to secure said door, panel, or window comprising:

a mounting bracket for installation on one of a fixed or opposing movable frame of a sliding door, sliding panel, or sliding window frame, respectively;

a male threaded fine adjustment mounting component hingeably attached to said mounting bracket thereof;

an outer fine adjustment barrel having opposing first and second ends, with its first end having internal female threads configured for engaging the threads on said male threaded fine adjustment mounting component, whereby a fine adjustment is accomplished between the outer fine adjustment barrel and the male threaded fine adjustment mounting component by rotating the outer fine adjustment barrel in a clockwise or counter clockwise direction for causing the outer fine adjustment barrel to respectively move toward or away from its associated fixed or movable frame;

major adjustment means including:

an inner telescoping major adjustment barrel having first and second ends, it's first end being configured for insertion into said second end of said outer fine adjustment barrel for providing relatively coarse adjustments accomplished by extending the inner telescoping major adjustment barrel from within the outer fine adjustment barrel in increments determined by holes located at predetermined intervals in the inner telescoping major adjustment barrel thereof;

locking pin means configured for insertion through opposing holes in both the outer fine adjustment barrel and major adjustment means, for locking the inner telescoping major adjustment barrel in a locking position within the outer fine adjustment barrel thereof to attain a desired extended length between free ends thereof; and means for releasably securing said second end of said second barrel in a freely rotatable manner while at a fixed position, either one of attached or mounted or connected to one of said stationary frame or said movable frame of one of said sliding door, sliding panel, or sliding window, on a longitudinal axis, whereby the longitudinal axis is a common axis, in a longitudinal direction, along the center of both the first and second barrels;

whereby locking of the sliding door, panel, or window is attained by first loosely wedging the extended sliding door lock between a frame of said sliding door, panel, or window, and the associated movable sliding. door, panel, or window, respectively, followed secondly by rotating the outer fine adjustment barrel about the threaded fine adjustment mounting component in one direction for causing the threaded engagement of these two components to unscrew for extending the locking mechanism to create a sufficient wedge force to prevent the sliding door, panel, or window from being opened;

whereby unlocking of the locked sliding door, panel, or window is attained by rotating the outer fine adjustment barrel about the threaded fine adjustment mounting component in another direction for causing the threaded engagement therebetween to screw together thereby reducing the extended length between the free ends of said fine adjustment barrel and major adjustment barrel for permitting the sliding door lock to be removed.

18. The adjustable lock of claim 17, further including said mounting bracket and said mounting component being configured to permit said lock to hang downward from said mounting component whenever said lock is not in use.

19. The adjustable lock of claim 17, wherein said securing means includes:

a retaining cup rigidly secured to the other one of said fixed or movable frame of the one of said sliding door, sliding panel, or sliding window, respectively, said retaining cup being configured for receiving and retaining the second end of said major adjustment barrel.

* * * * *